US010392584B2

(12) United States Patent
Roerdink Lander et al.

(10) Patent No.: US 10,392,584 B2
(45) **Date of Patent: *Aug. 27, 2019**

(54) DETERGENT COMPOSITION COMPRISING A POLYMER THAT PERFORMS BOTH A CLEANING AND RINSING FUNCTION

(71) Applicant: ECOLAB USA INC., Saint Paul, MN (US)

(72) Inventors: Monique Roerdink Lander, Saint Paul, MN (US); Carter M. Silvernail, Saint Paul, MN (US); Erin Jane Dahlquist Howlett, Saint Paul, MN (US); Kerrie E. Walters, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/707,656

(22) Filed: Sep. 18, 2017

(65) Prior Publication Data

US 2018/0010068 A1 Jan. 11, 2018

Related U.S. Application Data

(63) Continuation of application No. 14/635,746, filed on Mar. 2, 2015, now Pat. No. 9,796,947.

(60) Provisional application No. 61/949,377, filed on Mar. 7, 2014.

(51) Int. Cl.

| | |
|---|---|
| ***C11D 1/825*** | (2006.01) |
| ***C11D 3/36*** | (2006.01) |
| ***C11D 3/37*** | (2006.01) |
| ***C11D 3/10*** | (2006.01) |
| ***C11D 3/06*** | (2006.01) |
| ***C11D 3/33*** | (2006.01) |
| *C11D 1/72* | (2006.01) |

(52) U.S. Cl.

CPC ..... *C11D 1/8255* (2013.01); *C11D 3/06* (2013.01); *C11D 3/10* (2013.01); *C11D 3/33* (2013.01); *C11D 3/361* (2013.01); *C11D 3/3757* (2013.01); *C11D 1/72* (2013.01)

(58) Field of Classification Search

CPC ..... C11D 1/8255

See application file for complete search history.

(56) References Cited

U.S. PATENT DOCUMENTS

| | | | | |
|---|---|---|---|---|
| 3,929,678 | A * | 12/1975 | Laughlin | C07F 9/54 510/349 |
| 4,233,171 | A | 11/1980 | McLaughlin et al. | |
| 5,612,305 | A | 3/1997 | Lewis | |
| 6,034,044 | A | 3/2000 | Scheper et al. | |
| RE38,262 | E | 10/2003 | Rolando et al. | |
| 3,038,262 | A1 | 10/2003 | Rolando et al. | |
| 6,827,795 | B1 * | 12/2004 | Kasturi | A61K 8/44 134/39 |
| 7,041,628 | B2 | 5/2006 | Sunder et al. | |
| 2002/0179124 | A1 * | 12/2002 | Van Hauwermeiren | A47L 13/00 134/34 |
| 2003/0144172 | A1 | 7/2003 | Weuthen | |
| 2004/0167049 | A1 | 8/2004 | Kessler et al. | |
| 2004/0254090 | A1 | 12/2004 | Lentsch et al. | |
| 2006/0199750 | A1 * | 9/2006 | Berger | C11D 1/66 510/220 |
| 2007/0017553 | A1 | 1/2007 | Neplenbroek et al. | |
| 2007/0082836 | A1 | 4/2007 | Both et al. | |
| 2008/0293615 | A1 * | 11/2008 | Kieffer | C11D 3/0026 510/514 |
| 2009/0192064 | A1 * | 7/2009 | Geret | B08B 3/08 510/161 |
| 2010/0065090 | A1 | 3/2010 | Tropsch | |
| 2010/0139705 | A1 | 6/2010 | Oberlander | |
| 2010/0154831 | A1 | 6/2010 | Neplenbroek et al. | |
| 2010/0160204 | A1 * | 6/2010 | Zipfel | C11D 1/721 510/220 |
| 2010/0222247 | A1 * | 9/2010 | Zipfel | C11D 3/36 510/222 |
| 2010/0311633 | A1 * | 12/2010 | Johnson | C11D 3/044 510/221 |

(Continued)

FOREIGN PATENT DOCUMENTS

| | | | | |
|---|---|---|---|---|
| DE | 20014919 U1 | 11/2000 | | |
| EP | 0687720 A2 * | 12/1995 | | C11D 1/72 |

(Continued)

OTHER PUBLICATIONS

European Patent Office, "Extended European Search Report" issued in connection to International Application No. PCT/US2015/018352, dated Aug. 2, 2017 Aug. 2, 2017.

Australian Government, "Examination Report No. 1 for Standard Patent Application", dated Jan. 12, 2017, 3 pages. 2017.

Australian Government, "Examination Report No. 2 for Standard Patent Application", dated May 8, 2017, 2 pages. 2017.

Australian Government, "Examination Report No. 3 for Standard Patent Application", dated Sep. 27, 2017, 3 pages. Sep. 27, 2017.

Correction from Canada PTO—Office Action, U.S. Pat. No. 2,941,511 Sep. 11, 2017.

Diversey/Suma Combi Brochure—Final, www.diversey.com/sumacombi, "Simplify Your Dishwashing". Feb. 19, 2014.

Translation of Action, Japan Office Action, "Notice of Reasons for Rejection" pp. 1-7. dated Oct. 31, 2017.

Ecolab USA Inc., PCT/US2015/018352, "Written Opinion of the International Searching Authority", dated Jun. 30, 2015.

*Primary Examiner* — Nicole M. Buie-Hatcher
*Assistant Examiner* — M. Reza Asdjodi
(74) *Attorney, Agent, or Firm* — McKee, Voorhees & Sease, PLC

(57) ABSTRACT

Industrial 2-in-1 cleaning compositions providing both detergency and rinseability in a single cleaning composition comprising a polymer are disclosed. Alkali metal carbonate-based cleaning compositions and methods of both making and using the same provide user-friendly, solid, detergent compositions without the need for using a separate rinse aid composition. The compositions and methods are particularly well suited for use in industrial cleaning using alkali metal carbonate compositions that beneficially provide cleaning and rinseability in the rinse cycle.

19 Claims, 2 Drawing Sheets

(56) References Cited

U.S. PATENT DOCUMENTS

| | | | | |
|---|---|---|---|---|
| 2011/0232692 | A1 | 9/2011 | Zipfel et al. | |
| 2012/0167922 | A1 | 7/2012 | Sendor-Muller et al. | |
| 2012/0225943 | A1* | 9/2012 | Gohl | A01N 41/04 514/558 |
| 2012/0291815 | A1* | 11/2012 | Monsrud | C11D 3/042 134/25.2 |
| 2013/0074875 | A1 | 3/2013 | Neplenbroek et al. | |

FOREIGN PATENT DOCUMENTS

| | | | | |
|---|---|---|---|---|
| EP | 687720 | A2 | 12/1995 | |
| EP | 1103599 | B1 | 5/2001 | |
| EP | 1299517 | B2 | 4/2003 | |
| JP | 8034993 | A | 2/1996 | |
| JP | 2007119753 | A | 5/2007 | |
| JP | 2007131659 | A | 5/2007 | |
| JP | 2012188586 | A | 10/2012 | |
| JP | 2013237792 | A | 11/2013 | |
| WO | 9832823 | A1 | 7/1998 | |
| WO | WO-02064722 | A2 * | 8/2002 | C11D 3/3945 |

* cited by examiner

DETERGENT COMPOSITION COMPRISING A POLYMER THAT PERFORMS BOTH A CLEANING AND RINSING FUNCTION

CROSS-REFERENCE TO RELATED APPLICATIONS

This application is a continuation application of U.S. Ser. No. 14/635,746 filed Mar. 2, 2015, which claims priority under 35 U.S.C. § 119 to provisional application Ser. No. 61/949,377 filed Mar. 7, 2014, herein incorporated by reference in its entirety.

This application is related to U.S. Ser. No. 14/635,704 (claiming priority under 35 U.S.C. § 119 to provisional application Ser. No. 61/949,387) and also entitled Detergent Composition That Performs Both a Cleaning and Rinsing Function. The entire contents of this patent application are hereby expressly incorporated herein by reference including, without limitation, the specification, claims, and abstract, as well as any figures, tables, or drawings thereof.

FIELD OF THE INVENTION

The invention relates to an industrial 2-in-1 cleaning composition providing both detergency and rinse aid efficacy in a single cleaning composition comprising a polymer. In particular, compositions and methods of both making and using the same provide a user-friendly, solid, detergent composition without the need for using a separate rinse aid composition. The compositions and methods are particularly well suited for use in industrial cleaning using alkali metal carbonate compositions that beneficially provide cleaning and rinseability to permit the use of a potable water rinse without the addition of a separate rinse agent.

BACKGROUND OF THE INVENTION

Alkaline detergents are used extensively to clean articles in both consumer and industrial dish machines. Alkaline detergents are extensively used because of their ability to remove and emulsify fatty, oily, hydrophobic soils. However, alkaline detergents have the disadvantage of requiring a rinse aid to prevent the formation of films on glass and other substrate surfaces contacted by the alkaline detergent. Filming is caused in part by using alkaline detergents in combination with certain water types (including hard water), and water temperatures. A solution to the generation of hard water films has been to employ rinse aids to remove such films. However, the need for rinse aids increases the cost associated with alkaline detergents for both the formulation of the cleaning compositions as well as the additional costs associated with heated water for rinsing steps.

Additionally, rinse aids are used in a rinse cycle following the wash cycle to enhance drying time, as well as reduce any cleaning imperfections (including the removal of films). Additional benefits and methods of using rinse aids are described in U.S. Pat. No. RE 38,262, which is herein incorporated by reference in its entirety. The addition of rinse aids to a ware wash rinse cycle requires use of GRAS (generally recognized as safe) ingredients as well as wall space for the installation of both a detergent dispenser and a rinse aid dispenser.

There is a need for alternative, effective cleaning compositions that provide the desired cleaning results and at the same time reduce the number of components required for cleaning and rinsing.

Accordingly, it is an objective of the claimed invention to develop an alkaline detergent composition that provides good cleaning performance and good rinseability in a potable water rinse without the use of an added rinse aid in the rinse cycle.

A further object of the invention is to provide a carbonate-based alkaline detergent employing a combination of at least two surfactants and a polycarboxylic acid polymer, to provide good cleaning performance and rinseability without the use of a rinse aid in the cleaning composition.

A further object of the invention is to provide a carbonate-based alkaline detergent employing a combination of surfactants, and optionally polymers, providing at least substantially similar cleaning and rinsing efficacy as a conventional combination of a detergent composition and separate rinse aid composition.

Other objects, advantages and features of the present invention will become apparent from the following specification taken in conjunction with the accompanying drawings.

BRIEF SUMMARY OF THE INVENTION

An advantage of the invention is industrial detergent compositions providing both detergency and rinseability in a single cleaning composition, thus eliminating the need for an additional rinse aid composition. The composition of the invention provides thus a user-friendly, solid, 2-in-1 cleaning and rinsing action, beneficially eliminating a distinct rinse aid from the industrial warewashing compositions and methods of use. The alkaline detergent compositions according to the invention beneficially provide both good cleaning performance and rinseability in a potable water rinse without the use of an added rinse aid in the rinse cycle.

In an embodiment, the present invention provides a composition comprising a carbonate alkalinity source in combination with nonionic surfactants and a polycarboxylic acid polymer, where the composition replaces the separate use of both a dish machine detergent and a rinse additive due to the superior cleaning and rinseability of the composition. The detergent compositions can also include builders, water conditioning agents, neutralizing agents, etc.

In another embodiment, the present invention provides methods of cleaning articles in an industrial dish machine using a carbonate-based alkaline detergent comprising an alkali metal carbonate, nonionic surfactants and a polycarboxylate polymer. The invention also pertains to a method of cleaning articles in an industrial dish machine using the steps of supplying the alkaline 2-in-1 composition, inserting the composition into a dispenser in a dish machine, forming a wash solution with the composition and water, contacting soil on an article in the dish machine with the wash solution, removing the soil, and rinsing the article without the use of additional rinse aids.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
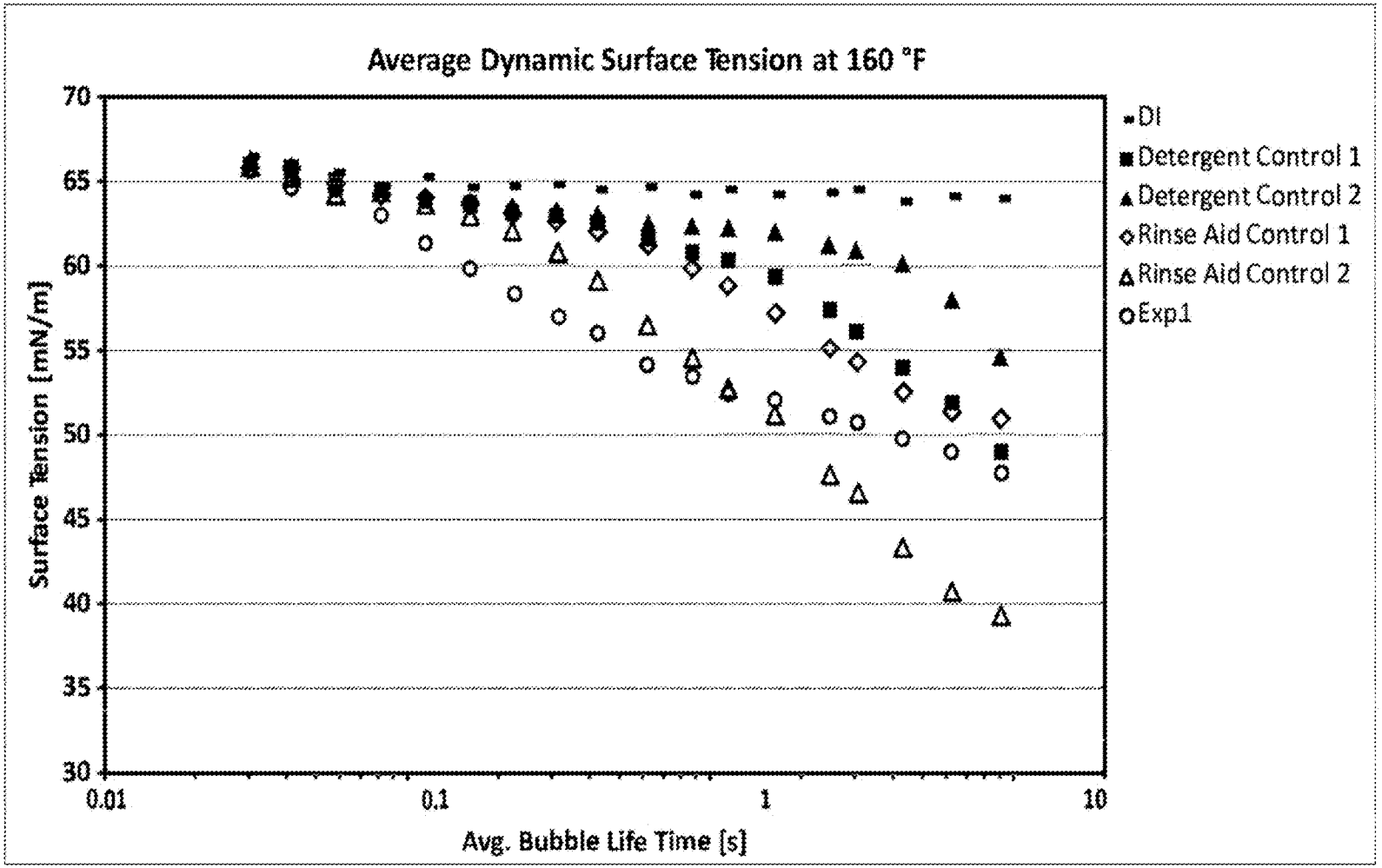
FIG. 1 shows a graph of the average dynamic surface tension of an experimental formulation in comparison to phosphate-based alkaline detergents as well as nonionic-based rinse aids at a temperature of 160° F. as a function of the average bubble life time at use concentrations. The values shown are averages of three independent measurements. According to an embodiment of the invention, the experimental formulation demonstrates a quick decrease and significant drop in surface tension, similar to a well-performing commercial rinse aid, such as rinse aid control 2.

Various embodiments of the present invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION OF THE PREFERRED EMBODIMENT

The present invention relates to a 2-in-1 industrial alkaline cleaning compositions which provide suitable cleaning and rinseability while employing a carbonate-based alkaline detergent and a combination of surfactants and at least one polymer. In an exemplary embodiment, the nonionic surfactants create an efficacious aqueous rinse with potable water. The embodiments of this invention are not limited to particular alkaline detergents, which can vary and are understood by skilled artisans based upon the disclosure provided herein. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form.

Numeric ranges recited within the specification are inclusive of the numbers defining the range and include each integer within the defined range. Throughout this disclosure, various aspects of this invention are presented in a range format. It should be understood that the description in range format is merely for convenience and brevity and should not be construed as an inflexible limitation on the scope of the invention. Accordingly, the description of a range should be considered to have specifically disclosed all the possible sub-ranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6, etc., as well as individual numbers within that range, for example, 1, 2, 3, 4, 5, and 6. This applies regardless of the breadth of the range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, the term "alkyl" refers to a straight or branched chain monovalent hydrocarbon group optionally containing one or more heteroatomic substitutions independently selected from S, O, Si, or N. Alkyl groups generally include those with one to twenty atoms. Alkyl groups may be unsubstituted or substituted with those substituents that do not interfere with the specified function of the composition. Substituents include alkoxy, hydroxy, mercapto, amino, alkyl substituted amino, or halo, for example. Examples of "alkyl" as used herein include, but are not limited to, methyl, ethyl, n-propyl, n-butyl, n-pentyl, isobutyl, isopropyl, and C8-C20 alkyl chains and the like. In addition, "alkyl" may include "alkylenes", "alkenylenes", or "alkylynes". As used herein, the term "alkylene" refers to a straight or branched chain divalent hydrocarbon group optionally containing one or more heteroatomic substitutions independently selected from S, O, Si, or N. Alkylene groups generally include those with one to twenty atoms. Alkylene groups may be unsubstituted or substituted with those substituents that do not interfere with the specified function of the composition. Substituents include alkoxy, hydroxy, mercapto, amino, alkyl substituted amino, or halo, for example. Examples of "alkylene" as used herein include, but are not limited to, methylene, ethylene, propane-1,3-diyl, propane-1,2-diyl and the like.

As used herein, the term "alkenylene" refers to a straight or branched chain divalent hydrocarbon group having one or more carbon-carbon double bonds and optionally containing one or more heteroatomic substitutions independently selected from S, O, Si, or N. Alkenylene groups generally include those with one to twenty atoms. Alkenylene groups may be unsubstituted or substituted with those substituents that do not interfere with the specified function of the composition. Substituents include alkoxy, hydroxy, mercapto, amino, alkyl substituted amino, or halo, for example. As used herein, the term "alkylyne" refers to a straight or branched chain divalent hydrocarbon group having one or more carbon-carbon triple bonds and optionally containing one or more heteroatomic substitutions independently selected from S, O, Si, or N. Alkylyne groups generally include those with one to twenty atoms. Alkylyne groups may be unsubstituted or substituted with those substituents that do not interfere with the specified function of the composition. Substituents include alkoxy, hydroxy, mercapto, amino, alkyl substituted amino, or halo, for example.

As used herein, the term "alkoxy", refers to —O-alkyl groups wherein alkyl is as defined above. As used herein, the term "cleaning" refers to a method used to facilitate or aid in soil removal, bleaching, microbial population reduction, and any combination thereof.

The term "generally recognized as safe" or "GRAS," as used herein refers to components classified by the Food and Drug Administration as safe for direct human food consumption or as an ingredient based upon current good manufacturing practice conditions of use, as defined for example in 21 C.F.R. Chapter 1, § 170.38 and/or 570.38.

As used herein, the term "soil" or "stain" refers to a polar or non-polar substances which may or may not contain particulate matter such as, but not limited to mineral clays, sand, natural mineral matter, carbon black, graphite, kaolin, environmental dust and food soils such as polyphenols, starches, proteins, oils and fats, etc.

As used herein, the term "substantially free" refers to compositions completely lacking the component or having such a small amount of the component that the component does not affect the performance of the composition. The component may be present as an impurity or as a contaminant and shall be less than 0.5 wt-%. In another embodiment, the amount of the component is less than 0.1 wt-% and in yet another embodiment, the amount of component is less than 0.01 wt-%.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both.

The term "threshold agent" refers to a compound that inhibits crystallization of water hardness ions from solution, but that need not form a specific complex with the water hardness ion. Threshold agents include but are not limited to a polyacrylate, a polymethacrylate, an olefin/maleic copolymer, and the like.

As used herein, the term "ware" refers to items such as eating and cooking utensils, and dishes. As used herein, the term "warewashing" refers to washing, cleaning, or rinsing ware. Ware also refers to items made of plastic. Types of plastics that can be cleaned with the compositions according to the invention include but are not limited to, those that include polycarbonate polymers (PC), acrilonitrile-butadiene-styrene polymers (ABS), and polysulfone polymers (PS). Other exemplary plastics that can be cleaned using the compounds and compositions of the invention include polyethylene terephthalate (PET) and plastics from melamine resin.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein. As used herein, "consisting essentially of" means that the methods and compositions may include additional steps, components or ingredients, but only if the additional steps, components or ingredients do not materially alter the basic and novel characteristics of the claimed methods and compositions.

Alkaline 2-in-1 Detergent Compositions

Alkalinity Source

The alkaline detergent compositions include an alkalinity source. The alkalinity source comprises an alkali metal carbonate. Examples of suitable alkalinity sources include but are not limited to: alkali metal carbonates, such as sodium carbonate, potassium carbonate, bicarbonate, sesquicarbonate, and mixtures thereof. In an aspect, the alkaline detergent compositions do not include a hydroxide alkalinity source. The alkalinity source controls the pH of the use solution when water is added to the detergent composition to form a use solution. The pH of the use solution must be maintained in the alkaline range in order to provide sufficient detergency properties. In one embodiment, the pH of the use solution is between about 9 and about 12. Particularly, the pH of the use solution is between about 9.5 and about 11.5.

In certain embodiments, the alkalinity source may also function as a hydratable salt to form a solid composition. The hydratable salt can be referred to as substantially anhydrous. By substantially anhydrous, it is meant that the component contains less than about 2% by weight water based upon the weight of the hydratable component. The amount of water can be less than about 1% by weight, and can be less than about 0.5% by weight. As one skilled in the art will ascertain, there is no requirement that the hydratable salt be completely anhydrous. In certain embodiments, there is also water of hydration to hydrate the alkalinity source (i.e. hydratable salt). It should be understood that the reference to water includes both water of hydration and free water. The phrase "water of hydration" refers to water which is somehow attractively bound to a non-water molecule. An exemplary form of attraction includes hydrogen bonding. The water of hydration also functions to increase the viscosity of the mixture during processing and cooling to prevent separation of the components. The amount of water of hydration in the detergent composition will depend on the alkalinity source/hydratable salt. In addition to water of hydration, the detergent composition may also have free water which isn't attractively bound to a non-water molecule.

In an aspect, the alkaline detergent compositions include from about 10 wt-%-95 wt-% alkalinity source, from about 25 wt-%-90 wt-% alkalinity source, from about 40 wt-%-85 wt-% alkalinity source, preferably from about 45 wt-%-75 wt-% alkalinity source. In addition, without being limited according to the invention, all ranges recited are inclusive of the numbers defining the range and include each integer within the defined range.

Surfactants

The 2-in-1 alkaline compositions according to the invention employ a combination of surfactants to provide good cleanability and rinseability. In an embodiment, the surfactants of the alkaline detergent compositions include at least two nonionic surfactants. In embodiment, the nonionic surfactants comprise an alcohol alkoxylate and an EO/PO copolymer. In an alternative embodiment, the nonionic surfactants comprise an alcohol alkoxylate and an alkyl alkoxylate. In a still further embodiment, the nonionic surfactants are selected from the group consisting of an alcohol alkoxylate, an alkyl alkoxylate, an EO/PO copolymer, and combinations thereof. In an aspect, the alkaline detergent compositions include from about 0.1 wt-%-30 wt-% surfactants, from about 0.1 wt-%-25 wt-% surfactants, from about 0.1 wt-%-20 wt-% surfactants, from about 1 wt-%-15 wt-% surfactants, and preferably from about 5 wt-%-10 wt-% surfactants. In addition, without being limited according to the invention, all ranges recited are inclusive of the numbers defining the range and include each integer within the defined range.

In some embodiments, the ratio of the alcohol alkoxylate to the alkyl alkoxylate (preferably EO/PO copolymer) is preferably from about 1:5 to about 5:1, more preferably from about 1:3 to about 3:1, and most preferably from about 1:2 to about 2:1. In an exemplary embodiment, the nonionic surfactants include an alkyl alkoxylate (preferably EO/PO copolymer) and alcohol alkoxylate in a ratio of about 1:1, from about 1:5 to about 5:1, from about 1:3 to about 3:1, or from about 1:2 to about 2:1. In a preferred aspect, the alkaline detergent composition includes an alkyl alkoxylate (preferably EO/PO copolymer) and alcohol alkoxylate in a ratio of about 1:1 Alcohol Alkoxylates The 2-in-1 alkaline compositions according to the invention employ at least one nonionic surfactant comprising an alcohol alkoxylate. Suitable alcohol alkoxylates include ethylene oxide, propylene oxide, and butylene oxide groups and mixtures thereof. Particularly, suitable alcohol alkoxylates can have between about 1 and about 30 moles of alkyl oxide and carbon chains between about 4 and about 20 carbons in length. In a preferred embodiment the alcohol ethoxylate may be a C8-C18 alcohol alkoxylate with about 10 to about 40 moles of alkyl oxide. In a more preferred embodiment the alcohol alkoxylate may be a C8-C16-alcohol alkoxylate with about 10 to about 30 moles of alkyl oxide. In an even more preferred embodiment, the alcohol alkoxylate may be a C10-C12 alcohol alkoxylate with about 15 to about 25 moles of alkyl oxide. Examples of preferred alcohol alkoxylates are available under the brands Surfonic (available from Huntsman), Rhodasurf (available from Rhodia), Novel (available from Sasol), Lutensol (available from BASF).

In an aspect of the invention, the alkaline detergent compositions include from about 0.1 wt-% to about 15 wt-% alcohol alkoxylate, from about 0.1 wt-% to about 10 wt-% alcohol alkoxylate, from about 0.1 wt-% to about 7 wt-%, or from about 1 wt-% to about 49 wt-%.

Alkyl Alkoxylates (EO/PO Copolymer)

The 2-in-1 alkaline compositions according to the invention employ an alkyl alkoxylate. Alkyl alkoxylates having ethylene oxide/propylene oxide derivatives or copolymer (EO/PO) copolymer surfactant are particularly suitable for the alkaline compositions. The EO/PO copolymer may have from about 1 to about 50 moles of EO and from about 1 to about 50 moles of PO. In a preferred embodiment, the EO/PO copolymer is a block polymer. In another aspect of the invention, the EO/PO copolymer does not contain a C8-18 alkyl group, or even any alkyl groups.

These EO/PO copolymer surfactants can include a compact alcohol EO/PO surfactant where the EO and PO groups are in small block form, or random form. In other embodiments, the alkyl alkoxylate includes an ethylene oxide, a propylene oxide, a butylene oxide, a pentalene oxide, a hexylene oxide, a heptalene oxide, an octalene oxide, a nonalene oxide, a decylene oxide, and mixtures thereof. The alkyl group can be C10-C18, linear or branched. In an aspect, the EO/PO copolymer surfactants are particularly suitable for use in the 2-in-1 alkaline compositions in combination with an alcohol alkoxylate surfactant. Exemplary commercially available surfactants are available, for example, under the tradename Pluronic® and Pluronic R, (commercially available from BASF), Tetronic (available from Dow) and Surfonic (available from Huntsman).

Some examples of ethylene oxide and/or propylene oxide derivative surfactants that may be used include polyoxyethylene-polyoxypropylene block copolymers, or the like, or derivatives thereof. Some examples of polyoxyethylene-polyoxypropylene block copolymers include those having the following formulae:

$$(EO)x(PO)y(EO)x$$

$$(PO)y(EO)x(PO)y$$

$$(PO)_y(EO)_x(PO)_y(EO)_x(PO)_y$$

wherein EO represents an ethylene oxide group, PO represents a propylene oxide group, and x and y reflect the average molecular proportion of each alkylene oxide monomer in the overall block copolymer composition. In an aspect of the invention, a preferred EO/PO copolymer is represented by the formula (EO)x(PO)y(EO)x. In a further aspect of the invention, a preferred EO/PO copolymer is represented by the formula (PO)y(EO)x(PO)y. In some embodiments, x is in the range of about 5 to about 50, y is in the range of about 1 to about 50, and x plus y is in the range of about 6 to about 200. It should be understood that each x and y in a molecule can be different. In some embodiments, the material can have a molecular weight greater than about 200 and less than about 25,000. For example, in some embodiments, the material can have a molecular weight in the range of about 500 to about 25,000, or in the range of about 1000 to about 20,000.

In some embodiments, the EO/PO surfactants may have between about 1 and about 50 ethylene oxide groups and from about 1 to about 50 propylene oxide groups. In some embodiments, the material can have a molecular weight greater than about 400, and in some embodiments, greater than about 500. For example, in some embodiments, the material can have a molecular weight (g/mol) in the range of about 500 to about 7000 or more, or in the range of about 950 to about 4000 or more, or in the range of about 1000 to about 3100 or more, or in the range of about 2100 to about 6700 or more, or in the range of about 2500 to about 4200 or more.

The treatise Nonionic Surfactants, edited by Schick, M. J., Vol. 1 of the Surfactant Science Series, Marcel Dekker, Inc., New York, 1983 provides further description of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and detergents" (Vol. I and II by Schwartz, Perry and Berch). Each of these references is herein incorporated by reference in their entirety.

In an aspect of the invention, the alkaline detergent compositions include from about 0.1 wt-% to about 15 wt-% of the alkyl alkoxylate (preferably EO/PO copolymer surfactant), from about 0.1 wt-% to about 10 wt-% of the alkyl alkoxylate (preferably EO/PO copolymer surfactant), or from about 0.1 wt-% to about 7 wt-% the alkyl alkoxylate (preferably EO/PO copolymer surfactant).

Polymer

The present invention includes a polymer comprised of at least one polycarboxylic acid polymer, copolymer, and/or terpolymer. Particularly suitable polycarboxylic acid polymers of the present invention, include, but are not limited to, polyacrylic acid polymers and copolymers, polymaleic polymers and copolymers, and acrylic/maleic copolymers. Other suitable polycarboxylic acid polymers include polymaleic acid homopolymers, polyacrylic acid copolymers, and maleic anhydride/olefin copolymers. In a preferred embodiment, the polymer comprises, consists essentially of, or consists of a polyacrylic acid polymer, copolymer, terpolymer and/or salts thereof.

The detergent compositions of the present invention can use polyacrylic acid polymers, copolymers, and/or terpolymers. Polyacrylic acids have the following structural formula:

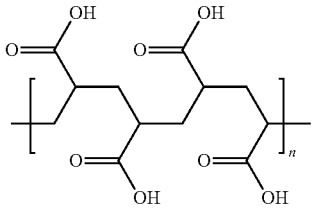

where n is any integer. Examples of suitable polyacrylic acid polymers, copolymers, and/or terpolymers, include but are not limited to, the polymers, copolymers, and/or terpolymers of polyacrylic acids, $(C_3H_4O_2)_n$ or 2-Propenoic acid, acrylic acid, polyacrylic acid, propenoic acid.

In an embodiment of the present invention, particularly suitable acrylic acid polymers, copolymers, and/or terpolymers have a molecular weight between about 100 and about 10,000, in a preferred embodiment between about 500 and about 7,000, in an even more preferred embodiment between about 1,000 and about 5,000, and in a most preferred embodiment between about 1,500 and about 4,500.

Polymaleic acid $(C_4H_2O_3)x$ or hydrolyzed polymaleic anhydride or cis-2-butenedioic acid homopolymer, has the structural formula:

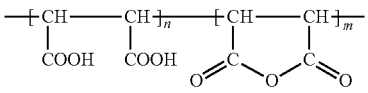

where n and m are any integer. Examples of polymaleic acid homopolymers, copolymers, and/or terpolymers (and salts thereof) which may be used for the invention are particularly preferred are those with a molecular weight of about 100 and about 10,000, more preferably between about 500 and about 7,000, in an even more preferred embodiment between about 1,000 and about 5,000, and in a most preferred embodiment between about 1,500 and about 4,500. Commercially available polymaleic acid homopolymers include the Belclene 200 series of maleic acid homopolymers from BWA™ Water Additives, 979 Lakeside Parkway, Suite 925 Tucker, Ga. 30084, USA and Aquatreat AR-801 available from AkzoNobel.

In a preferred embodiment, the polymer is a copolymer of acrylic acid and maleic acid. Preferably, an acrylic/maleic acid copolymer an acrylic/maleic copolymer has a molecular weight from about 1,000 to about 10,000 g/mol, preferably a molecular weight between about 1,000 to about 5,000 g/mol. An example of a suitable acrylic/maleic acid copolymer includes, but is not limited to, Acusol 448 from The Dow Chemical Company, Wilmington Del., USA.

In embodiments it is expected that the compositions will include the polymer in an amount between about 0.1 wt-% and about 50 wt-%, between about 0.1 wt-% and about 40 wt-%, between about 0.1 wt-% and about 30 wt-%, or 1 wt-% and about 20 wt-%. All ranges recited are inclusive of the numbers contained therein. The polymer of the present invention can comprise, consist essentially of, or consist of at least one polyacrylic acid polymer, copolymer, and/or terpolymer. In addition, without being limited according to the invention, all ranges recited are inclusive of the numbers defining the range and include each integer within the defined range.

Additional Functional Ingredients

The 2-in-1 alkaline compositions according to the invention can further be combined with various functional components suitable for use in industrial ware wash applications. In some embodiments, the alkaline detergent and rinse aid compositions including the carbonate-based alkalinity source, nonionic surfactants, and polymers make up a large amount, or even substantially all of the total weight of the detergent composition. For example, in some embodiments few or no additional functional ingredients are disposed therein.

In other embodiments, additional functional ingredients may be included in the compositions. The functional ingredients provide desired properties and functionalities to the compositions. For the purpose of this application, the term "functional ingredient" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional ingredients may be used. For example, many of the functional materials discussed below relate to materials used in cleaning, specifically ware wash applications. However, other embodiments may include functional ingredients for use in other applications.

In preferred embodiments, the compositions do not include additional alkalinity sources, namely alkali metal hydroxides as alkalinity sources. In further preferred embodiments, the compositions do not include rinse aids.

In other embodiments, the compositions may include builders, water conditioning agents, stabilizers, defoaming agents, anti-redeposition agents, bleaching agents, sanitizers, solubility modifiers, dispersants, anticorrosion agents and metal protecting agents, stabilizing agents, corrosion inhibitors, enzymes, additional sequestrants and/or chelating agents, fragrances and/or dyes, rheology modifiers or thickeners, hydrotropes or couplers, buffers, solvents, solidifying agents, neutralizing agents and the like.

Builders

The alkaline detergent composition can include one or more building agents, also called chelating or sequestering agents (e.g. builders) to treat or soften water and to prevent formation of precipitates or other salts. These may include, but are not limited to: condensed phosphates, alkali metal carbonates, alkali metal silicates and metasilicates, phosphonates, aminocarboxylic acids, and/or polycarboxylic acid polymers. In general, a chelating agent is a molecule capable of coordinating (i.e. binding) the metal ions commonly found in natural water to prevent the metal ions from interfering with the action of the other detersive ingredients of a cleaning composition. Preferable levels of addition for builders that can also be chelating or sequestering agents are between about 0.1% to about 70% by weight, about 1% to about 60% by weight, about 5% to about 50% by weight, or about 20% to about 50% by weight. If the solid detergent is provided as a concentrate, the concentrate can include between approximately 1% to approximately 60% by weight, between approximately 3% to approximately 50% by weight, and between approximately 6% to approximately 45% by weight of the builders. In addition, without being limited according to the invention, all ranges recited are inclusive of the numbers defining the range and include each integer within the defined range.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the detergent composition by fixing the free water present in the composition as water of hydration. A preferred builder is sodium tripolyphosphate anhydrous.

Examples of phosphonates include, but are not limited to: 2-phosphonobutane-1,2,4-tricarboxylic acid (PBTC), 1-hydroxyethylidene-1,1-diphosphonic acid (HEDP), $CH_2C(OH)[PO(OH)_2]_2$; aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_2$; diethylenetriaminepenta(methylenephosphonate), sodium salt (DTPMP), $C_9H_{(28-x)}N_3Na_xO_{15}P_5$ (x=7); hexamethylenediamine(tetramethylenephosphonate), potassium salt, $C_{10}H_{(28-x)}N_2K_xO_{12}P_4$ (x=6); bis(hexamethylene)triamine (pentamethylenephosphonic acid), $(HO_2)POCH_2N[CH_2)_2N[CH_2PO(OH)_2]_2]_2$; and phosphorus acid, $H_3PO_3$. A neutralized or alkali phosphonate, or a combination of the phosphonate with an alkali source prior to being added into the mixture such that there is little or no heat or gas generated by a neutralization reaction when the phosphonate is added is preferred. In one embodiment, however, the detergent composition is phosphorous-free.

Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), aspartic acid-N,N-diacetic acid (ASDA), methylglycinediacetic acid (MGDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2-2'-iminodisuccinic acid (HIDS) and other similar acids or salts thereof having an amino group with a carboxylic acid substituent. In one embodiment, however, the composition is free of aminocarboxylates.

Water conditioning polymers can also be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate (—$CO_2$—) groups such as polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. Other suitable water conditioning polymers include starch, sugar or polyols comprising carboxylic acid or ester functional groups. Exemplary carboxylic acids include but are not limited to maleic, acrylic, methacrylic and itaconic acid or salts thereof. Exemplary ester functional groups include aryl, cyclic, aromatic and $C_1$-$C_{10}$ linear, branched or substituted esters. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at substoichiometric levels to function as crystal modifiers.

Water Conditioning Agents

The alkaline detergent compositions can include one or more water conditioning agents. In an aspect, phosphonic acids can be employed. Phosphonic acids can be used in the form of water soluble acid salts, particularly the alkali metal salts, such as sodium or potassium; the ammonium salts; or the alkylol amine salts where the alkylol has 2 to 3 carbon atoms, such as mono-, di-, or triethanolamine salts. Preferred phosphonates include the organic phosphonates. Preferred organic phosphonates include phosphono butane tricarboxylic acid (PBTC) available from Bayer Corp. in Pittsburgh Pa. under the tradename of BAYHIBIT™ and hydroxy ethylidene diphosphonic acid (HEDP) such as that sold under the tradename of DEQUEST™ 2010 available from Monsanto Chemical Co. Additional description of suitable water conditioning agents for use in the invention is described in U.S. Pat. No. 6,436,893, which is herein incorporated by reference herein in its entirety.

In an aspect, the compositions include from about 0.1 wt-%-50 wt-% water conditioning agent, from about 1 wt-%-40 wt-% water conditioning agent, from about 1 wt-%-30 wt-% water conditioning agent, preferably from about 5 wt-%-20 wt-% water conditioning agent. In addition, without being limited according to the invention, all ranges recited are inclusive of the numbers defining the range and include each integer within the defined range.

Neutralizing Agents

The alkaline detergent compositions may also include a neutralizing agent. For example, in certain embodiments an alkaline neutralizing agent may be employed to neutralize acidic components, such as a water conditioning agent. Suitable alkaline neutralizing agents may include for example alkali metal hydroxides, including but not limited to: sodium hydroxide, potassium hydroxide, lithium hydroxide, and combinations thereof. An alkali metal hydroxide neutralizing agent may be added to the composition in any form known in the art, including as solid beads, dissolved in an aqueous solution, or a combination thereof. Additionally, more than one neutralizing agent may be used according to certain embodiments. In an aspect of the invention, the compositions of the invention do not include hydroxides as alkalinity sources but only to neutralize acidic ingredients in the composition, including for example water conditioning agents such as HEDP.

In an aspect, the compositions include from about 0.1 wt-%-50 wt-% neutralizing agent, from about 0.1 wt-%-30 wt-% neutralizing agent, from about 1 wt-%-25 wt-% neutralizing agent, preferably from about 10 wt-%-25 wt-% neutralizing agent. In an embodiment of the invention, the neutralizing agent comprises alkali metal hydroxide in an amount of up to about 10 wt-%, preferably between about 0.01 wt-% and about 10 wt-%. In addition, without being limited according to the invention, all ranges recited are inclusive of the numbers defining the range and include each integer within the defined range.

Anti-Etch Agents

The alkaline detergent compositions may also include an anti-etch agent capable of preventing etching in glass.

Examples of suitable anti-etch agents include adding metal ions to the composition such as zinc, zinc chloride, zinc gluconate, aluminum, and beryllium. The corrosion inhibitor can refer to the combination of a source of aluminum ion and a source of zinc ion. The source of aluminum ion and the source of zinc ion provide aluminum ion and zinc ion, respectively, when the solid detergent composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof. Exemplary sources of aluminum ion include, but are not limited to: aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, and aluminum phosphate. Exemplary sources of zinc ion include, but are not limited to: zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, and zinc salicylate. The composition preferably includes from about 0.001 wt-% to about 10 wt-%, more preferably from about 0.01 wt-% to about 7 wt-%, and most preferably from about 0.01 wt-% to about 1 wt-% of an anti-etch agent. In addition, without being limited according to the invention, all ranges recited are inclusive of the numbers defining the range and include each integer within the defined range.

Anticorrosion Agents

The alkaline detergent compositions may optionally include an anticorrosion agent. Anticorrosion agents provide compositions that generate surfaces that are shinier and less prone to biofilm buildup than surfaces that are not treated with compositions having anticorrosion agents.

Preferred anticorrosion agents which can be used according to the invention include phosphonates, phosphonic acids, triazoles, organic amines, sorbitan esters, carboxylic acid derivatives, sarcosinates, phosphate esters, zinc, nitrates, chromium, molybdate containing components, and borate containing components. Exemplary phosphates or phosphonic acids are available under the name Dequest (i.e., Dequest 2000, Dequest 2006, Dequest 2010, Dequest 2016, Dequest 2054, Dequest 2060, and Dequest 2066) from Solutia, Inc. of St. Louis, Mo. Exemplary triazoles are available under the name Cobratec (i.e., Cobratec 100, Cobratec TT-50-S, and Cobratec 99) from PMC Specialties Group, Inc. of Cincinnati, Ohio. Exemplary organic amines include aliphatic amines, aromatic amines, monoamines, diamines, triamines, polyamines, and their salts. Exemplary amines are available under the names Amp (i.e. Amp-95) from Angus Chemical Company of Buffalo Grove, Ill.; WGS (i.e., WGS-50) from Jacam Chemicals, LLC of Sterling, Kans.; Duomeen (i.e., Duomeen O and Duomeen C) from Akzo Nobel Chemicals, Inc. of Chicago, Ill.; DeThox amine (C Series and T Series) from DeForest Enterprises, Inc. of Boca Raton, Fla.; Deriphat series from Henkel Corp. of Ambler, Pa.; and Maxhib (AC Series) from Chemax, Inc. of Greenville, S.C. Exemplary sorbitan esters are available under the name Calgene (LA-series) from Calgene Chemical Inc. of Skokie, Ill. Exemplary carboxylic acid derivatives are available under the name Recor (i.e., Recor 12) from Ciba-Geigy Corp. of Tarrytown, N.Y. Exemplary sarcosinates are available under the names Hamposyl from Hampshire Chemical Corp. of Lexington, Mass.; and Sarkosyl from Ciba-Geigy Corp. of Tarrytown, N.Y.

The composition optionally includes an anticorrosion agent for providing enhanced luster to the metallic portions of a dish machine and/or providing shinier surfaces. When an anticorrosion agent is incorporated into the composition, it is preferably included in an amount of between about 0.01 wt-% and about 7.5 wt-%, between about 0.01 wt-% and about 5 wt-%, and between about 0.01 wt-% and about 3 wt-%.

Antiredeposition Agents

The alkaline detergent compositions may also include an antiredeposition agent capable of facilitating sustained suspension of soils in a cleaning solution and preventing the removed soils from being redeposited onto the substrate being cleaned. Examples of suitable antiredeposition agents include fatty acid amides, complex phosphate esters, styrene maleic anhydride copolymers, and cellulosic derivatives such as hydroxyethyl cellulose, hydroxypropyl cellulose, and the like. The composition preferably includes from about 0.5 wt-% to about 10 wt-% and more preferably from about 1 wt-% to about 5 wt-% of an antiredeposition agent.

Enzymes

The alkaline detergent compositions can include one or more enzymes, which can provide desirable activity for removal of protein-based, carbohydrate-based, or triglyceride-based soils from substrates such as flatware, cups and bowls, and pots and pans. Enzymes suitable for the inventive composition can act by degrading or altering one or more types of soil residues encountered on a surface thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized, or otherwise more easily removed by detersive solutions containing said proteases.

Suitable enzymes include a protease, an amylase, a lipase, a gluconase, a cellulase, a peroxidase, or a mixture thereof of any suitable origin, such as vegetable, animal, bacterial, fungal or yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. In some embodiments preferably the enzyme is a protease, a lipase, an amylase, or a combination thereof. A valuable reference on enzymes, which is incorporated herein by reference is "Industrial Enzymes," Scott, D., in Kirk-Othmer Encyclopedia of Chemical Technology, 3rd Edition, (editors Grayson, M. and EcKroth, D.) Vol. 9, pp. 173-224, John Wiley & Sons, New York, 1980.

In embodiments employing an enzyme the composition preferably includes from about 0.001 wt-% to about 10 wt-%, from about 0.01 wt-% to about 10 wt-%, from about 0.05 wt-% to about 5 wt-%, and more preferably from about 0.1 wt-% to about 1 wt-% of enzyme(s).

Antimicrobial Agent

The alkaline detergent compositions may optionally include an antimicrobial agent or preservative. Antimicrobial agents are chemical compositions that can be used in the composition to prevent microbial contamination and deterioration of commercial products material systems, surfaces, etc. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds. The given antimicrobial agent depending on chemical composition and concentration may simply limit further proliferation of numbers of the microbe or may destroy all or a substantial proportion of the microbial population. The terms "microbes" and "microorganisms" typically refer primarily to bacteria and fungus microorganisms. In use, the antimicrobial agents are formed into the final product that when diluted and dispensed using an aqueous stream forms an aqueous disinfectant or sanitizer composition that can be contacted with a variety of surfaces resulting in prevention of growth or the killing of a substantial proportion of the microbial population. Common antimicrobial agents that may be used include phenolic antimicrobials such as pentachlorophenol, orthophenylphenol; halogen containing antibacterial agents that may be used include sodium trichloroisocyanurate, sodium dichloroisocyanurate (anhydrous or dihydrate), iodine-poly (vinylpyrolidin-onen) complexes, bromine compounds such as 2-bromo-2-nitropropane-1,3-diol; quaternary antimicrobial agents such as benzalconium chloride, cetylpyridinium-chloride; amines and nitro containing antimicrobial compositions such as hexahydro-1,3,5-tris(2-hydr-oxyethyl)-s-triazine, dithiocarbamates such as sodium dimethyldithiocarbamate, and a variety of other materials known in the art for their microbial properties. Antimicrobial agents may be encapsulated to improve stability and/or to reduce reactivity with other materials in the detergent composition.

When an antimicrobial agent or preservative is incorporated into the composition, it is preferably included in an amount between about 0.01 wt-% to about 5 wt-%, between about 0.01 wt-% to about 2 wt-%, and between about 0.1 wt-% to about 1.0 wt-%.

Foam Inhibitors

A foam inhibitor may be included in addition to the nonionic surfactants of the alkaline cleaning compositions for reducing the stability of any foam that is formed. Examples of foam inhibitors include silicon compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, polyoxyethylene-polyoxypropylene block copolymers, alkyl phosphate esters such as monostearyl phosphate and the like. A discussion of foam inhibitors may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein. The composition preferably includes from about 0.0001 wt-% to about 5 wt-% and more preferably from about 0.01 wt-% to about 3 wt-% of the foam inhibitor.

Additional Surfactants

The compositions of invention may include additional surfactants. Particularly suitable surfactants include nonionic surfactants, amphoteric surfactants, and zwitterionic surfactants. In a preferred embodiment the compositions are substantially free of cationic and/or anionic surfactants. In an aspect, the compositions can include from about 0.01 wt-%-40 wt-% additional surfactants, preferably from about 0.1 wt-%-30 wt-% additional surfactant, more preferably from about 1 wt-%-25 wt-% additional surfactant. In addition, without being limited according to the invention, all ranges recited are inclusive of the numbers defining the range and include each integer within the defined range.

Nonionic Surfactants

Suitable nonionic surfactants suitable for use with the compositions of the present invention include alkoxylated surfactants. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic and reverse Pluronic surfactants; alcohol alkoxylates, such as Dehypon LS-54 (R-$(EO)_5(PO)_4$) and Dehypon LS-36 (R-$(EO)_3(PO)_6$); and capped alcohol alkoxylates, such as Plurafac LF221 and Tegoten EC11; mixtures thereof, or the like.

The semi-polar type of nonionic surface active agents is another class of nonionic surfactant useful in compositions of the present invention. Semi-polar nonionic surfactants include the amine oxides, phosphine oxides, sulfoxides and their alkoxylated derivatives.

Amine oxides are tertiary amine oxides corresponding to the general formula:

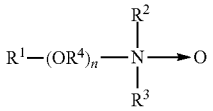

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkylene or a hydroxyalkylene group containing 2 to 3 carbon atoms; and n ranges from 0 to about 20. An amine oxide can be generated from the corresponding amine and an oxidizing agent, such as hydrogen peroxide.

Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, isododecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl) amine oxide, 3,6,9-trioctadecyldimethylamine oxide and 3-dodecoxy-2-hydroxypropyldi-(2-hydroxyethyl)amine oxide.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" Cosmetics & Toiletries, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

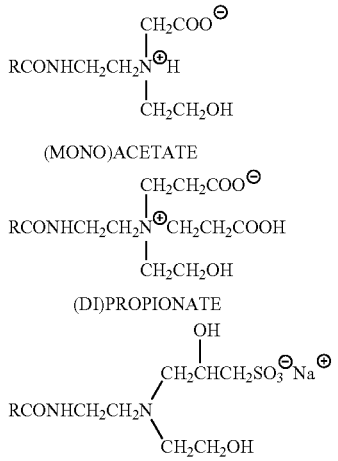

Neutral pH - Zwitterion wherein R is an acyclic hydrophobic group containing from about 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, R can be an acyclic hydrophobic group containing from about 8 to about 18 carbon atoms, and M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—N+($CH_2$—$CH_2$—$CO_2Na)_2$—$CH_2$—$CH_2$—OH or $C_{12}$-alkyl-C(O)—N(H)—$CH_2$—$CH_2$—N+($CH_2$—$CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

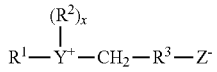

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

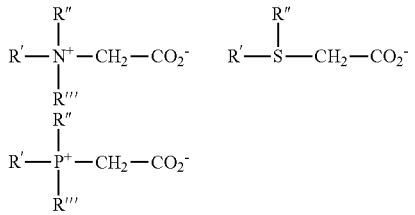

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). Each of these references is herein incorporated in their entirety.

In an embodiment, the compositions of the present invention include a betaine. For example, the compositions can include cocoamido propyl betaine.

Embodiments

Exemplary ranges of the 2-in-1 alkaline detergent compositions according to the invention are shown in Table 1 in weight percentage of the solid detergent compositions.

TABLE 1

| Material | First Exemplary Range wt-% | Second Exemplary Range wt-% | Third Exemplary Range wt-% | Fourth Exemplary Range wt-% |
|---|---|---|---|---|
| Alkalinity Source | 10-95 | 25-90 | 40-85 | 45-75 |
| Polymer | 0.1-50 | 0.1-40 | 0.1-30 | 1-20 |
| Builders | 0.1-50 | 1-50 | 5-45 | 10-35 |
| Surfactants | 0.1-30 | 0.1-25 | 0.1-20 | 1-10 |
| Additional Functional Ingredients | 0-40 | 0-30 | 0-25 | 0-20 |

The detergent compositions may include concentrate compositions or may be diluted to form use compositions. In general, a concentrate refers to a composition that is intended to be diluted with water to provide a use solution that contacts an object to provide the desired cleaning, rinsing, or the like. The detergent composition that contacts the articles to be washed can be referred to as a concentrate or a use composition (or use solution) dependent upon the formulation employed in methods according to the invention. It should be understood that the concentration of the aminocarboxylate, water conditioning agent, alkalinity, water and other optional functional ingredients in the detergent composition will vary depending on whether the detergent composition is provided as a concentrate or as a use solution.

A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 10,000 but will depend on factors including water hardness, the amount of soil to be removed and the like. In an embodiment, the concentrate is diluted at a ratio of between about 1:10 and about 1:10,000 concentrate to water. Particularly, the concentrate is diluted at a ratio of between about 1:100 and about 1:5,000 concentrate to water.

More particularly, the concentrate is diluted at a ratio of between about 1:250 and about 1:2,000 concentrate to water.

Method of Use—Cleaning an Article in a Dish Machine

In an embodiment, methods of the present invention involve using the steps of providing an alkaline 2-in-1 detergent composition as disclosed herein. In particular, methods of use preferably employ a solid alkaline 2-in-1 detergent composition, wherein a solid composition is inserted into a dispenser in or associated with an dish machine, particularly an industrial warewash machine. In an embodiment of the invention, the solid composition may be provided as a multiple-use dosage having between about 10 and about 10,000 doses per solid composition. In another aspect of the invention, the solid composition can be formulated in a single-use composition, where it is used one time in a wash. The methods also include forming a wash solution with the alkaline 2-in-1 detergent composition and water, contacting a soil on an article in the dish machine with the wash solution, removing the soil, and rinsing the article with potable water without requiring the use of a separate rinse aid composition. The rinse is with potable water only.

In another embodiment, the methods of the present invention may involve providing the individual components of the 2-in-1 detergent composition separately and mixing the individual components in situ with water to form a desired wash solution.

When carrying out the methods of the invention, the 2-in-1 detergent compositions described above are inserted into a dispenser of a dish machine. The dispenser may be selected from a variety of different dispensers depending of the physical form of the composition. For example, a liquid composition may be dispensed using a pump, either peristaltic or bellows for example, syringe/plunger injection, gravity feed, siphon feed, aspirators, or a foil pouch, evacuation from a pressurized chamber, or diffusion through a membrane or permeable surface. If the composition is a gel or a thick liquid, it may be dispensed using a pump such as a peristaltic or bellows pump, syringe/plunger injection, caulk gun, unit dose, for example using a water soluble packet such as polyvinyl alcohol or a foil pouch, evacuation from a pressurized chamber, or diffusion through a membrane or permeable surface. Preferably, when the composition is a solid or powder, the composition may be dispensed using a spray, flood, auger, shaker, tablet-type dispenser, foil pouch, or diffusion through a membrane or permeable surface. The dispenser may also be a dual dispenser in which one component, is dispensed on one side and another component is dispensed on another side. These exemplary dispensers may be located in or associated with a variety of dish machines including under the counter dish machines, bar washers, door machines, conveyor machines, or flight machines. The dispenser may be located inside the dish machine, remote, or mounted outside of the dishwasher. A single dispenser may feed one or more dish machines.

Once the 2-in-1 detergent composition is inserted into the dispenser, the wash cycle of the dish machine is started and a wash solution is formed. The wash solution comprises the alkaline 2-in-1 detergent composition and water from the dish machine. The water may be any type of water including hard water, soft water, clean water, or dirty water. The most preferred wash solution is one that maintains the preferred pH ranges of about 7 to about 11.5, more preferably about 9.5 to about 11.5, as measured by a pH probe based on a solution of the composition in a 16 gallon dish machine. The same probe may be used to measure millivolts if the probe allows for both functions, simply by switching the probe from pH to millivolts. The dispenser or the dish machine may optionally include a pH probe to measure the pH of the wash solution throughout the wash cycle. The actual concentration or water to detergent ratio depends on the particular surfactant used. Exemplary concentration ranges may include up to 3000 ppm, preferably 1 to 3000 ppm, more preferably 100 to 3000 ppm and most preferably 300 to 2000 ppm. Again, the actual concentration used depends on the surfactant chosen.

A use solution can have an elevated temperature (i.e. heated to an elevated temperature when used according to the methods of the invention. In one example, a use solution having a temperature between approximately 120° F. and about 185° F., between about 140° F. and approximately 185° F. is contacted with the substrate to be cleaned. In another example, a use solution having a temperature between approximately 150° F. and approximately 160° F. is contacted with the substrate to be cleaned.

After the wash solution is formed, the wash solution contacts a soil on an article in the dish machine. Examples of soils include soils typically encountered with food such as proteinaceous soils, hydrophobic fatty soils, starchy and sugary soils associated with carbohydrates and simple sugars, soils from milk and dairy products, fruit and vegetable soils, and the like. Soils can also include minerals, from hard water for example, such as potassium, calcium, magnesium, and sodium. Articles that may be contacted include articles made of glass, plastic, aluminum, steel, copper, brass, silver, rubber, wood, ceramic, and the like. Articles include things typically found in a dish machine such as glasses, bowls, plates, cups, pots and pans, bakeware such as cookie sheets, cake pans, muffin pans etc., silverware such as forks, spoons, knives, cooking utensils such as wooden spoons, spatulas, rubber scrapers, utility knives, tongs, grilling utensils, serving utensils, etc. The wash solution may contact the soil in a number of ways including spraying, dipping, sump-pump solution, misting and fogging.

Once the wash solution has contacted the soil, the soil is removed from the article. The removal of the soil from the article is accomplished by the chemical reaction between the wash solution and the soil as well as the mechanical action of the wash solution on the article depending on how the wash solution is contacting the article.

Once the soil is removed, the articles are rinsed as part of the dish machine wash cycle employing potable water without the use of a separate or additional rinse aid composition.

The methods can include more steps or fewer steps than laid out here. For example, the method can include additional steps normally associated with a dish machine wash cycle. For example, the method can also optionally include the use of an acidic detergent. For example, the method can optionally include alternating the acidic detergent with an alkaline detergent as described.

Method of Manufacturing the Composition

The compositions of the present invention may include liquid products, thickened liquid products, gelled liquid products, paste, granular and pelletized solid compositions, powders, solid block compositions, cast solid block compositions, extruded solid block composition and others.

Solid particulate materials can be made by merely blending the dry solid ingredients in appropriate ratios or agglomerating the materials in appropriate agglomeration systems. Pelletized materials can be manufactured by compressing the solid granular or agglomerated materials in appropriate pelletizing equipment to result in appropriately sized pelletized materials. Solid block and cast solid block materials can be made by introducing into a container either a prehardened block of material or a castable liquid that hardens into a solid block within a container. Preferred containers include disposable plastic containers or water soluble film containers. Other suitable packaging for the composition includes flexible bags, packets, shrink wrap, and water soluble film such as polyvinyl alcohol.

The solid detergent compositions may be formed using a batch or continuous mixing system. In an exemplary embodiment, a single- or twin-screw extruder is used to combine and mix one or more components at high shear to form a homogeneous mixture. In some embodiments, the processing temperature is at or below the melting temperature of the components. The processed mixture may be dispensed from the mixer by forming, casting or other suitable means, whereupon the detergent composition hardens to a solid form. The structure of the matrix may be characterized according to its hardness, melting point, material distribution, crystal structure, and other like properties according to known methods in the art. Generally, a solid detergent composition processed according to the method of the invention is substantially homogeneous with regard to the distribution of ingredients throughout its mass and is dimensionally stable.

In an extrusion process, the liquid and solid components are introduced into final mixing system and are continuously mixed until the components form a substantially homogeneous semi-solid mixture in which the components are distributed throughout its mass. The mixture is then discharged from the mixing system into, or through, a die or other shaping means. The product is then packaged. In an exemplary embodiment, the formed composition begins to harden to a solid form in between approximately 1 minute and approximately 3 hours. Particularly, the formed composition begins to harden to a solid form in between approximately 1 minute and approximately 2 hours. More particularly, the formed composition begins to harden to a solid form in between approximately 1 minute and approximately 20 minutes.

In a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least approximately 60 seconds. Once the mixing is complete, the product is transferred to a packaging container where solidification takes place. In an exemplary embodiment, the cast composition begins to harden to a solid form in between approximately 1 minute and approximately 3 hours. Particularly, the cast composition begins to harden to a solid form in between approximately 1 minute and approximately 2 hours. More particularly, the cast composition begins to harden to a solid form in between approximately 1 minute and approximately 20 minutes.

In a pressed solid process, a flowable solid, such as granular solids or other particle solids including binding agents (e.g. hydrated chelating agent, such as a hydrated aminocarboxylate, a hydrated polycarboxylate or hydrated anionic polymer, a hydrated citrate salt or a hydrated tartrate salt, or the like together with an alkali metal carbonate) are combined under pressure. In a pressed solid process, flowable solids of the compositions are placed into a form (e.g., a mold or container). The method can include gently pressing the flowable solid in the form to produce the solid cleaning composition. Pressure may be applied by a block machine or a turntable press, or the like. Pressure may be applied at about 1 to about 2000 psi, about 1 to about 300 psi, about 5 psi to about 200 psi, or about 10 psi to about 100 psi. In certain embodiments, the methods can employ pressures as low as greater than or equal to about 1 psi, greater than or equal to about 2, greater than or equal to about 5 psi, or greater than or equal to about 10 psi. As used herein, the term "psi" or "pounds per square inch" refers to the actual pressure applied to the flowable solid being pressed and does not refer to the gauge or hydraulic pressure measured at a point in the apparatus doing the pressing. The method can include a curing step to produce the solid cleaning composition. As referred to herein, an uncured composition including the flowable solid is compressed to provide sufficient surface contact between particles making up the flowable solid that the uncured composition will solidify into a stable solid cleaning composition. A sufficient quantity of particles (e.g. granules) in contact with one another provides binding of particles to one another effective for making a stable solid composition. Inclusion of a curing step may include allowing the pressed solid to solidify for a period of time, such as a few hours, or about 1 day (or longer). In additional aspects, the methods could include vibrating the flowable solid in the form or mold, such as the methods disclosed in U.S. Pat. No. 8,889,048, which is herein incorporated by reference in its entirety.

The use of pressed solids provide numerous benefits over conventional solid block or tablet compositions requiring high pressure in a tablet press, or casting requiring the melting of a composition consuming significant amounts of energy, and/or by extrusion requiring expensive equipment and advanced technical know-how. Pressed solids overcome such various limitations of other solid formulations for which there is a need for making solid cleaning compositions. Moreover, pressed solid compositions retain its shape under conditions in which the composition may be stored or handled.

By the term "solid", it is meant that the hardened composition will not flow and will substantially retain its shape under moderate stress or pressure or mere gravity. A solid may be in various forms such as a powder, a flake, a granule, a pellet, a tablet, a lozenge, a puck, a briquette, a brick, a solid block, a unit dose, or another solid form known to those of skill in the art. The degree of hardness of the solid cast composition and/or a pressed solid composition may range from that of a fused solid product which is relatively dense and hard, for example, like concrete, to a consistency characterized as being a hardened paste. In addition, the term "solid" refers to the state of the detergent composition under the expected conditions of storage and use of the solid detergent composition. In general, it is expected that the detergent composition will remain in solid form when exposed to temperatures of up to approximately 100° F. and particularly up to approximately 120° F.

The resulting solid detergent composition may take forms including, but not limited to: a cast solid product; an extruded, molded or formed solid pellet, block, tablet, powder, granule, flake; pressed solid; or the formed solid can thereafter be ground or formed into a powder, granule, or flake. In an exemplary embodiment, extruded pellet materials formed by the solidification matrix have a weight of between approximately 50 grams and approximately 250 grams, extruded solids formed by the composition have a weight of approximately 100 grams or greater, and solid block detergents formed by the composition have a mass of between approximately 1 and approximately 10 kilograms. The solid compositions provide for a stabilized source of functional materials. In some embodiments, the solid composition may be dissolved, for example, in an aqueous or other medium, to create a concentrated and/or use solution. The solution may be directed to a storage reservoir for later use and/or dilution, or may be applied directly to a point of use.

The following patents disclose various combinations of solidification, binding and/or hardening agents that can be utilized in the solid cleaning compositions of the present invention. The following U.S. patents are incorporated herein by reference: U.S. Pat. Nos. 7,153,820; 7,094,746; 7,087,569; 7,037,886; 6,831,054; 6,730,653; 6,660,707; 6,653,266; 6,583,094; 6,410,495; 6,258,765; 6,177,392; 6,156,715; 5,858,299; 5,316,688; 5,234,615; 5,198,198; 5,078,301; 4,595,520; 4,680,134; RE32,763; and RE32,818.

Liquid compositions can typically be made by forming the ingredients in an aqueous liquid or aqueous liquid solvent system. Such systems are typically made by dissolving or suspending the active ingredients in water or in compatible solvent and then diluting the product to an appropriate concentration, either to form a concentrate or a use solution thereof. Gelled compositions can be made similarly by dissolving or suspending the active ingredients in a compatible aqueous, aqueous liquid or mixed aqueous organic system including a gelling agent at an appropriate concentration.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

The materials used in the following Examples are provided herein:

Pluronic® 25R2: an EO/PO copolymer available from BASF.

Novel® II 1012GB-21: an alcohol alkoxylate available from Sasol.

Acusol® 448: a polyacrylic acid copolymer, available from the Dow Chemical Company.

Additional materials commercially-available from multiple sources include: sodium carbonate, ash monohydrate, sodium tripolyphosphate (anhydrous), zinc chloride, HEDP, and KOH.

An exemplary 2-in-1 detergent was prepared and is shown in Table 2. Throughout the Examples, the formulation is referred to as Experimental Formula 1 (Exp. 1).

TABLE 2

| Raw material | Exp. 1 |
|---|---|
| Alkalinity source | 45-75 |
| Builder | 10-30 |
| EO/PO copolymer | 1-20 |
| Alcohol alkoxylate | 1-10 |
| Polycarboxylic acid polymer | 1-10 |
| Corrosion inhibitor | 0.01-0.5 |
| Phosphonate builder, 60% | 1-10 |
| KOH, 45% | 1-10 |
| Total | 100 |

Existing detergents, rinse aids, and Experimental Formula 1 were tested against distilled water. Detergent Control 1 and Detergent Control 2 are commercially available detergents (phosphate-based detergents). Rinse Aid Control 1 and rinse Aid Control are two commercially available rinse aids (employing higher amounts of active ingredients surfactants of at least two ionic categories (e.g., nonionic and cationic)). The use concentrations for all experiments described below are provided in Table 3:

TABLE 3

| Sample | Use concentration [ppm] |
|---|---|
| DI water | N/A |
| Detergent Control 1 | 1500 |
| Detergent Control 2 | 1000 |
| Rinse Aid Control 1 | 536 |
| Rinse Aid Control 2 | 536 |
| Exp. 1 | 1415 |

All warewash testing was performed with 10 oz. Libbey glasses on a Hobart AM-15 warewash machine. The specifications of the Hobart AM-15 warewash machine are as follows:

Hobart AM-15 Warewash Machine Specifications.

| | |
|---|---|
| Washbath volume: | 53 L |
| Rinse volume: | 2.8 L |
| Wash time: | 50 sec. |
| Rinse time: | 9 sec. |

Example 1

Dynamic Surface Tension

The SITA science line t60 measures the dynamic surface tension of liquids up to the semi-static range. Air bubbles are generated from a capillary with known radius. The bubble pressure is measured as a function of bubble life time, which can be correlated to the surface tension according to the Young-Laplace equation. Dynamic surface tension provides insight into the dynamic behavior of surfactants and other surface active compounds under dynamic conditions, i.e. how quick surfactants can reach a surface. The dynamic surface tension is a function of concentration, temperature and type of surfactant.

The dynamic surface tension behavior of surfactants is particularly important in applications where a quick response of surfactants is required, for example, in the short rinse cycles of automated dishwashing.

Apparatus and Materials:

1. SITA T60 (Sita Messtechnik, Germany)
2. Oil bath with stir bar

3. Heating and stirring plate
4. Glass beakers
5. Glass vials (20 mL)

The SITA science line t60 was calibrated with DI water. Clean water samples after calibration should have a surface tension of 72.0±1.0 mN/m (depending on water quality and temperature). Following calibration, the SITA was programmed to take readings at the desired time intervals (i.e., 0.3, 1.6, 3.0, and 9.1 seconds). Three separate solutions at the desired ppm were prepared for each composition (described as Samples A-C) to be tested (e.g., three samples of Exp. 1, three samples of Detergent Control 1). 10-15 mL were transferred into 20 mL vials and immersed in a heated oil bath to 72° C. (160° F.)±2° C. The samples were equilibrated for 10-15 minutes. The samples were individually removed from the oil bath and the tested in the SITA. After each sample was tested the SITA's cleaning procedure was run, then the surface tension of DI water was checked to ensure the SITA was adequately clean. If the DI water measurements were not within 72.0±1.0 mN/m, then the cleaning procedure was run again. The surface tension (mN/m) versus bubble life time at 160° F. experimental data is provided in Tables 4-A through 4-F below, where τ is the bubble life time in seconds and γ is the surface tension in mN/m.

TABLE 4-A

| Detergent Control 1 | | | | | |
|---|---|---|---|---|---|
| Sample A | | Sample B | | Sample C | |
| τ | γ | τ | γ | τ | γ |
| 0.031 | 65.1 | 0.031 | 67.9 | 0.03 | 66.4 |
| 0.041 | 65 | 0.042 | 65.9 | 0.041 | 66.2 |
| 0.058 | 64.5 | 0.058 | 65.8 | 0.058 | 65 |
| 0.083 | 64.1 | 0.082 | 65.3 | 0.081 | 64.1 |
| 0.116 | 63.4 | 0.116 | 64.6 | 0.116 | 64.4 |
| 0.159 | 62.8 | 0.161 | 63.8 | 0.162 | 64.3 |
| 0.223 | 63 | 0.223 | 63.9 | 0.226 | 63.7 |
| 0.313 | 62.6 | 0.313 | 63.7 | 0.315 | 63.8 |
| 0.421 | 62.5 | 0.426 | 63.5 | 0.419 | 63.2 |
| 0.624 | 62.3 | 0.622 | 62.7 | 0.621 | 62.7 |
| 0.857 | 61.4 | 0.878 | 62.7 | 0.883 | 62.9 |
| 1.164 | 62 | 1.148 | 62.4 | 1.149 | 62.2 |
| 1.659 | 61.7 | 1.648 | 62.1 | 1.656 | 62.3 |
| 2.495 | 61.2 | 2.527 | 61.1 | 2.532 | 61.4 |
| 3.217 | 60.7 | 3.145 | 60.9 | 3.185 | 61.3 |
| 4.388 | 59.7 | 4.28 | 60.3 | 4.162 | 60.6 |
| 6.463 | 57.6 | 6.62 | 57.3 | 6.166 | 59.2 |
| 8.781 | 54.7 | 9.156 | 53.7 | 8.342 | 55.5 |
| 11.244 | 52 | 13.403 | 52.1 | 11.972 | 52.7 |
| 18.795 | 45.7 | 15.816 | 45.7 | 16.933 | 51 |
| 21.721 | 44.4 | 21.895 | 47.7 | 22.163 | 47.4 |

TABLE 4-B

| Detergent Control 2 | | | | | |
|---|---|---|---|---|---|
| Sample A | | Sample B | | Sample C | |
| τ | Γ | τ | γ | τ | γ |
| 0.031 | 65.8 | 0.03 | 66.6 | 0.03 | 65.8 |
| 0.041 | 65.9 | 0.041 | 66 | 0.042 | 65.6 |
| 0.058 | 65.5 | 0.058 | 65.1 | 0.058 | 64.6 |
| 0.082 | 64.7 | 0.082 | 64.7 | 0.082 | 64.1 |
| 0.115 | 63.9 | 0.115 | 63.9 | 0.116 | 63.8 |
| 0.161 | 64 | 0.162 | 63.6 | 0.16 | 63.5 |

TABLE 4-B-continued

| Detergent Control 2 | | | | | |
|---|---|---|---|---|---|
| Sample A | | Sample B | | Sample C | |
| τ | Γ | τ | γ | τ | γ |
| 0.226 | 63.5 | 0.223 | 62.9 | 0.225 | 63.2 |
| 0.317 | 63.6 | 0.316 | 62.4 | 0.315 | 63 |
| 0.429 | 63.3 | 0.428 | 61.9 | 0.42 | 62.4 |
| 0.629 | 62.2 | 0.623 | 61 | 0.632 | 61.7 |
| 0.888 | 61.7 | 0.882 | 59.7 | 0.867 | 60.9 |
| 1.171 | 61.5 | 1.145 | 59.2 | 1.114 | 60.4 |
| 1.673 | 60.5 | 1.57 | 58.2 | 1.607 | 59.5 |
| 2.515 | 58.8 | 2.451 | 55.1 | 2.409 | 58.4 |
| 2.993 | 57.4 | 2.878 | 54 | 2.945 | 57 |
| 4.326 | 54.8 | 4.113 | 51.5 | 4.015 | 55.6 |
| 6.455 | 52.6 | 5.751 | 49.9 | 6.017 | 53.2 |
| 8.989 | 49.9 | 9.861 | 46.7 | 7.906 | 50.4 |
| 11.373 | 44.3 | 12.865 | 44.1 | 12.578 | 46.6 |
| 16.815 | 43.1 | 15.861 | 43.8 | 17.397 | 45 |
| 23.12 | 40.9 | 22.161 | 41.5 | 26.01 | 44.7 |

TABLE 4-C

| Rinse Aid Control 1 | | | | | |
|---|---|---|---|---|---|
| Sample A | | Sample B | | Sample C | |
| τ | Γ | τ | γ | τ | γ |
| 0.031 | 66.3 | 0.03 | 65.6 | 0.03 | 65.6 |
| 0.042 | 66.2 | 0.041 | 65.6 | 0.042 | 65.6 |
| 0.058 | 65.1 | 0.058 | 64.8 | 0.058 | 64.8 |
| 0.082 | 64.8 | 0.081 | 63.9 | 0.081 | 63.9 |
| 0.114 | 65.1 | 0.115 | 63.6 | 0.113 | 63.4 |
| 0.161 | 64.3 | 0.16 | 63.5 | 0.159 | 63.1 |
| 0.227 | 63.8 | 0.227 | 62.7 | 0.225 | 62.7 |
| 0.317 | 63.1 | 0.317 | 62.5 | 0.313 | 62.3 |
| 0.44 | 62.4 | 0.426 | 61.9 | 0.425 | 61.8 |
| 0.619 | 61.5 | 0.626 | 61.4 | 0.622 | 60.8 |
| 0.848 | 59.8 | 0.866 | 60 | 0.879 | 59.7 |
| 1.173 | 58.8 | 1.152 | 59 | 1.143 | 58.8 |
| 1.641 | 56.7 | 1.601 | 57.5 | 1.592 | 57.5 |
| 2.491 | 54.8 | 2.381 | 55.3 | 2.336 | 55.3 |
| 3.126 | 53.9 | 2.862 | 54.6 | 2.979 | 54.4 |
| 4.692 | 52.2 | 4.014 | 52.9 | 4.46 | 52.4 |
| 6.112 | 51.7 | 5.869 | 51.5 | 6.398 | 50.9 |
| 8.935 | 51 | 8.418 | 51 | 9.057 | 50.7 |
| 11.571 | 51 | 12.22 | 49.9 | 12.613 | 49.9 |
| 18.684 | 49.9 | 18.629 | 49.9 | 17.07 | 49.1 |
| 29.293 | 48.3 | 24.928 | 48.7 | 21.252 | 49 |

TABLE 4-D

| Rinse Aid Control 2 | | | | | |
|---|---|---|---|---|---|
| Sample A | | Sample B | | Sample C | |
| τ | Γ | τ | γ | τ | γ |
| 0.031 | 65.6 | 0.03 | 66 | 0.03 | 66.1 |
| 0.041 | 65.5 | 0.041 | 64.6 | 0.042 | 65.7 |
| 0.058 | 64.5 | 0.058 | 64.5 | 0.057 | 63.8 |
| 0.082 | 64.8 | 0.082 | 64.2 | 0.082 | 64 |
| 0.113 | 64.2 | 0.113 | 63.1 | 0.116 | 63.7 |
| 0.16 | 63.6 | 0.162 | 62.7 | 0.162 | 62.5 |
| 0.225 | 62.9 | 0.228 | 61.9 | 0.22 | 61.5 |
| 0.313 | 61.8 | 0.312 | 60 | 0.314 | 60.5 |
| 0.424 | 60.2 | 0.417 | 58.6 | 0.424 | 58.7 |
| 0.592 | 57.2 | 0.621 | 56.4 | 0.609 | 55.9 |
| 0.856 | 55.4 | 0.874 | 54.3 | 0.854 | 53.9 |
| 1.119 | 53.9 | 1.097 | 52.4 | 1.115 | 52 |
| 1.612 | 52.4 | 1.609 | 50.5 | 1.539 | 50.6 |
| 2.476 | 49.9 | 2.363 | 48.1 | 2.26 | 44.8 |
| 3.115 | 48.2 | 2.835 | 47.7 | 2.831 | 43.9 |

TABLE 4-D-continued

| Rinse Aid Control 2 | | | | | |
|---|---|---|---|---|---|
| Sample A | | Sample B | | Sample C | |
| τ | Γ | τ | γ | τ | γ |
| 4.619 | 45.7 | 4.461 | 43.3 | 4.588 | 40.9 |
| 7.16 | 41.8 | 5.675 | 41 | 5.839 | 39.4 |
| 8.653 | 41.5 | 8.914 | 39.1 | 8.727 | 37.7 |
| 11.358 | 40.7 | 11.159 | 38 | 12.111 | 35.3 |
| | | 15.255 | 36.4 | 15.955 | 34.8 |
| | | | | 21.85 | 33.1 |

TABLE 4-E

| Experimental Formulation (Exp 1) | | | | | |
|---|---|---|---|---|---|
| Sample A | | Sample B | | Sample C | |
| τ | Γ | τ | γ | τ | γ |
| 0.03 | 64.7 | 0.03 | 66.7 | 0.031 | 65.6 |
| 0.41 | 64.3 | 0.43 | 65.3 | 0.043 | 64.3 |
| 0.058 | 66.1 | 0.058 | 64.4 | 0.058 | 63.2 |
| 0.083 | 63.9 | 0.081 | 62.5 | 0.082 | 62.5 |
| 0.118 | 62 | 0.116 | 61.5 | 0.116 | 60.6 |
| 0.167 | 59.9 | 0.161 | 60.2 | 0.161 | 59.3 |
| 0.221 | 58.5 | 0.225 | 58.8 | 0.225 | 57.8 |
| 0.313 | 57.6 | 0.313 | 57.1 | 0.313 | 56.3 |
| 0.427 | 57.6 | 0.43 | 525.6 | 0.423 | 55 |
| 0.627 | 54.3 | 0.622 | 54.4 | 0.632 | 53.7 |
| 0.871 | 54.4 | 0.867 | 53.3 | 0.886 | 52.7 |
| 1.169 | 52.8 | 1.161 | 52.3 | 1.145 | 52.2 |
| 1.727 | 536 | 1.652 | 51.5 | 1.656 | 51 |
| 2.467 | 52.5 | 2.543 | 50.4 | 2.572 | 50.3 |
| 3.145 | 52 | 3.515 | 49.9 | 3.092 | 50.2 |
| 4.234 | 20.9 | 4.49 | 49.1 | 4.389 | 49.3 |
| 6.126 | 50.3 | 6.261 | 48.3 | 6.106 | 48.4 |
| 9.11 | 48.1 | 8.886 | 47.7 | 8.891 | 47.3 |
| 12.609 | 48.2 | 11.701 | 46.7 | 12.448 | 46.5 |
| 18.514 | 47.1 | 17.215 | 45.4 | 17.854 | 45.5 |
| 22.164 | 45.3 | 23.579 | 44.9 | 23.081 | 44.7 |

TABLE 4-F

| DI Sample A | |
|---|---|
| τ | γ |
| 0.031 | 66.5 |
| 0.041 | 65 |
| 0.058 | 65.5 |
| 0.082 | 64.7 |
| 0.115 | 65.3 |
| 0.159 | 64.6 |
| 0.226 | 64.7 |
| 0.308 | 64.8 |
| 0.424 | 64.5 |
| 0.613 | 64.7 |
| 0.876 | 64.2 |
| 1.168 | 64.5 |
| 1.711 | 64.2 |
| 2.647 | 64.3 |
| 3.191 | 64.5 |
| 4.628 | 63.8 |
| 6.705 | 64.1 |
| 10.707 | 64 |

TABLE 5

| Sample | Avg. Surface Tension at 0.3 s | Avg. Surface Tension at 1.6 s | Avg. Surface Tension at 3.0 s | Avg. Surface Tension at 9.1 s |
|---|---|---|---|---|
| DI water | 64.8 | 64.2 | 64.5 | 64.0 |
| Detergent Control 1 | 63.0 | 59.4 | 56.1 | 49.0 |
| Detergent Control 2 | 63.4 | 62.0 | 61.0 | 54.6 |
| Rinse Aid Control 1 | 62.6 | 57.2 | 54.3 | 50.9 |
| Rinse Aid Control 2 | 60.8 | 51.2 | 46.6 | 39.2 |
| Exp. 1 | 57.0 | 52.0 | 50.7 | 47.7 |

The data demonstrates the surface tension of Experimental Formulation 1 decreases quickly with a significant drop in surface tension at the bubble life time of 9.1 seconds. This is similar to a well-performing rinse aid, such as Rinse Aid Control 2. These results are demonstrated in FIG. 1.

Example 2

One Hundred-Cycle Film Evaluation for Institutional Warewash Detergents

To determine the ability of various detergent compositions to remove spots and film from ware, six Libby 10 oz. glass tumblers were prepared by removing all film and foreign material from the surfaces of the glasses. A Hobart AM-15 warewash machine was then filled with an appropriate amount of water and the water was tested for hardness. After recording the hardness value, the tank heaters were turned on. On the day of the experiments, the water hardness was 17 grains. The warewash machine was turned on and wash/rinse cycles were run through the machine until a wash temperature of between about 150° F. and about 160° F. and a rinse temperature of between about 175° F. and about 190° F. were reached. The controller was then set to dispense an appropriate amount of detergent into the wash tank. The detergent was dispensed such that when the detergent was mixed with water during the cycle to form a use solution, the detergent concentration in the use solution was 750 parts per million (ppm). The solution in the wash tank was titrated to verify detergent concentration. The warewash machine had a washbath volume of 58 liters, a rinse volume of 2.8 liters, a wash time of 50 seconds, and a rinse time of 9 seconds.

Figure 2:
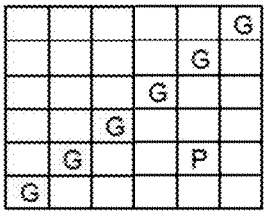
FIG. 2 shows the arrangement of ware on a Raburn rack as used in Example 2. "G" represents a glass tumbler and "P" represents a plastic tumbler.

The six clean glass tumblers were placed diagonally in a Raburn rack and four Newport 10 oz. plastic tumblers were placed off-diagonally in the Raburn rack (see FIG. 2. which depicts the arrangement) and the rack was placed inside the warewash machine. (P=plastic tumbler; G=glass tumbler).

The 100 cycle test was then started. At the beginning of each wash cycle, the appropriate amount of detergent was automatically dispensed into the warewash machine to maintain the initial detergent concentration. The detergent concentration was controlled by conductivity.

Upon completion of 100 cycles, the rack was removed from the warewash machine and the glass and plastic tumblers were allowed to dry. The glass and plastic tumblers were then graded for spot and film accumulation using film ratings and using an analytical light box evaluation. The film rating scale is provided in Table 6:

TABLE 6

| Rating | Spots | Film |
|---|---|---|
| 1 | No spots | No Film |
| 2 | Spots at random | 20% of surface covered in film |
| 3 | ¼ glass spotted | 40% of the surface covered in film |
| 4 | ½ glass spotted | 60% of the surface covered in film |
| 5 | Whole glass spotted | At least 80% of the surface covered in film |

The light box test used a digital camera, a light box, a light source, a light meter and a control computer employing "Spot Advance" and "Image Pro Plus" commercial software. A glass to be evaluated was placed on its side on the light box, and the intensity of the light source was adjusted to a predetermined value using the light meter. A photographic image of the glass was taken and saved to the computer. The software was then used to analyze the upper half of the glass, and the computer displayed a histogram graph with the area under the graph being proportional to the thickness of the film.

Generally, a lower light box score indicates that more light was able to pass through the tumbler. Thus, the lower the light box score, the more effective the composition was at preventing scale on the surface of the tumbler. A clean, unused glass tumbler has a light box score of approximately 12,000, which corresponds to a score of 72,000 for the six glass tumblers, and a clean, unused plastic tumbler has a light box score of approximately 25,500, which corresponds to a light box score of approximately 102,000 for the four plastic tumblers. The minimum obtainable light box score (i.e., sum of six clean glass tumblers and four clean plastic tumblers) is approximately 174,000. Generally, a detergent composition is considered effective for controlling hard water scale if the sum of the light box scores for six glass tumblers and four plastic tumblers is approximately 360,000 or less.

The results of the 100-Cycle test are provided in Tables 7 and 8.

TABLE 7

| 100-cycle Film | G1 | G2 | G3 | G4 | G5 | G6 | Avg. Glass Score (St. Dev.) | Plastic Score P1 |
|---|---|---|---|---|---|---|---|---|
| Detergent Control 1 | 4.5 | 3.0 | 3.5 | 4.5 | 3.5 | 4.0 | 3.8 (0.6) | 1.5 |
| Detergent Control 2 | 5.0 | 3.5 | 4.0 | 4.5 | 4.5 | 4.0 | 4.3 (0.5) | 2.5 |

TABLE 7-continued

| 100-cycle Film | G1 | G2 | G3 | G4 | G5 | G6 | Avg. Glass Score (St. Dev.) | Plastic Score P1 |
|---|---|---|---|---|---|---|---|---|
| Detergent Control 1 + Rinse Aid Control 2 | 4.5 | 4.0 | 4.5 | 4.5 | 4.0 | 5.0 | 4.4 (0.3) | 3.5 |
| Detergent Control 2 + Rinse Aid Control 1 | 4.5 | 3.0 | 4.0 | 4.0 | 3.5 | 4.0 | 3.8 (0.5) | 2.5 |
| Exp. 1 | 3.0 | 1.5 | 1.5 | 1.5 | 1.5 | 2.0 | 1.8 (0.6) | 2.0 |

TABLE 8

| 100-cycle Light box | G1 | G2 | G3 | G4 | G5 | G6 | Summed Glass Score | Plastic Score P1 | Summed Total Score |
|---|---|---|---|---|---|---|---|---|---|
| Detergent Control 1 | Maxed (65535) | 38906 | 55734 | 62998 | 47238 | 59893 | 330304 | 17681 | 347985 |
| Detergent Control 2 | Maxed (65535) | 55061 | 59141 | 63854 | 63879 | 59859 | 367329 | 31530 | 398859 |
| Detergent Control 1 + Rinse Aid Control 2 | Maxed (65535) | 63291 | 65304 | 65226 | 65412 | Maxed (65535) | 390303 | 46448 | 436751 |
| Detergent Control 2 + Rinse Aid Control 1 | Maxed (65535) | 42699 | 54556 | 56364 | 50826 | 59589 | 329589 | 30727 | 360296 |
| Exp. 1 | 34088 | 18832 | 18644 | 18790 | 19312 | 20966 | 130632 | 18685 | 149317 |

Example 3

Fifty Cycle Redeposition Experiment for Institutional Warewash Detergents

The cleaning efficacy of the compositions according to the invention and controls were further evaluated using a 50 cycle redeposition experiment for institutional ware wash detergents. To test the ability of compositions to clean glass and plastic, 6 10 oz. Libby heat resistant glass tumblers and 1 plastic tumblers were used. The glass tumblers were cleaned prior to use. New plastic tumblers were used for each experiment.

A food soil solution was prepared using a 50/50 combination of beef stew and hot point soil and employed at 2000 ppm soil. The soil included two cans of Dinty Moore Beef Stew (1360 grams), one large can of tomato sauce (822 grams), 15.5 sticks of Blue Bonnet Margarine (1746 grams) and powered milk (436.4 grams). The hot point soil was added to the machine to maintain a sump concentration of about 2000 ppm.

Figure 3:
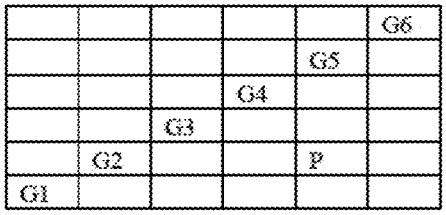
FIG. 3 shows the arrangement of ware on a Raburn rack as used in Example 3. "G" represents a glass tumbler and "P" represents a plastic tumbler.

After filling the dishmachine with 17 grain water, the heaters were turned on. The wash temperature was adjusted to about 150-160° F. The final rinse temperature was adjusted to about 175-190° F. The controller was set to disclose the amount of detergent in the wash tank. The glass and plastic tumblers were placed in the Raburn rack (see FIG. 3. which depicts the arrangement; P=plastic tumbler; G=glass tumbler) and the rack was placed inside the dishmachine.

The dishmachine was then started and run through an automatic cycle. At the beginning of each cycle the appropriate amount of hot point sol was added to maintain the sump concentration of 2000 ppm. The detergent concentration is controlled by conductivity.

When the 50 cycles ended, the glasses were allowed to dry overnight. Thereafter they were graded for spots and film accumulation (visual).

The glass and plastic tumblers were then graded for protein accumulation using Commassie Brilliant Blue R stain followed by destaining with an aqueous acetic acid/methanol solution. The Commassie Brilliant Blue R stain was prepared by combining 1.25 g of Commassie Brilliant Blue R dye with 45 mL of acetic acid and 455 mL of 50% methanol in distilled water. The destaining solution consisted of 45% methanol and 10% acetic acid in distilled water.

The amount of protein remaining on the glass and plastic tumblers after destaining was rated visually on a scale of 1 to 5. A rating of 1 indicated no protein was present after destaining—no spots/no film. A rating of 2 indicated that random areas (barely perceptible) were covered with protein after destaining—spots at random (or about 20% surface covered in film). A rating of 3 indicated that about a quarter to half of the surface was covered with protein after destaining (or about 40% surface covered in film). A rating of 4 indicated that about half of the glass/plastic surface was covered with protein after destaining (or about 60% surface covered in film). A rating of 5 indicated that the entire surface was coated with protein after destaining (or at least about 80% surface covered in film).

The ratings of the glass tumblers tested for soil removal were averaged to determine an average soil removal rating from glass surfaces and the ratings of the plastic tumblers tested for soil removal were averaged to determine an average soil removal rating from plastic surfaces. Similarly, the ratings of the glass tumblers tested for redeposition were averaged to determine an average redeposition rating for glass surfaces and the ratings of the plastic tumblers tested for redeposition were averaged to determine an average redeposition rating for plastic surfaces.

The results are shown in following tables, demonstrating that the detergent compositions according to the invention provide at least substantially similar cleaning efficacy and in various embodiments provide superior efficacy over commercial products. The rating scale is shown in Table 9.

TABLE 9

| Rating | Spots | Film |
|---|---|---|
| 1 | No spots | No Film |
| 2 | Spots at random | 20% of surface covered in film |
| 3 | ¼ glass spotted | 40% of the surface covered in film |
| 4 | ½ glass spotted | 60% of the surface covered in film |
| 5 | Whole glass spotted | At least 80% of the surface covered in film |

The results of the 50-Cycle test are provided in Tables 10 and 11:

TABLE 10

| 50-cycle Redeposition Spots | G1 | G2 | G3 | G4 | G5 | G6 | Avg. Glass Score (St. Dev.) | Plastic Score P1 |
|---|---|---|---|---|---|---|---|---|
| Detergent Control 1 | 1.5 | 1.5 | 1.0 | 1.5 | 1.0 | 1.0 | 1.3 (0.3) | 4.0 |

TABLE 10-continued

| 50-cycle Redeposition Spots | G1 | G2 | G3 | G4 | G5 | G6 | Avg. Glass Score (St. Dev.) | Plastic Score P1 |
|---|---|---|---|---|---|---|---|---|
| Detergent Control 2 | 2.0 | 1.5 | 1.5 | 1.0 | 2.0 | 1.5 | 1.6 (0.3) | 1.5 |
| Detergent Control 1 + Rinse Aid Control 2 | 1.5 | 1.5 | 1.0 | 1.0 | 1.5 | 1.5 | 1.3 (0.3) | 5.0 |
| Detergent Control 2 + Rinse Aid Control 1 | 1.5 | 1.0 | 1.0 | 1.0 | 1.0 | 1.5 | 1.2 (0.2) | 1.0 |
| Exp. 1 | 1.5 | 2.0 | 1.5 | 1.0 | 1.5 | 1.5 | 1.5 (0.3) | 5.0 |

TABLE 11

| 50-cycle Redeposition Film | G1 | G2 | G3 | G4 | G5 | G6 | Avg. Glass Score (St. Dev.) | Plastic Score P1 |
|---|---|---|---|---|---|---|---|---|
| Detergent Control 1 | 2.0 | 3.0 | 2.0 | 2.0 | 3.0 | 4.5 | 2.8 (1.0) | 1.5 |
| Detergent Control 2 | 5.0 | 4.5 | 4.5 | 5.0 | 4.5 | 5.0 | 4.8 (0.3) | 3.0 |
| Detergent Control 1 + Rinse Aid Control 2 | 5.0 | 2.0 | 2.0 | 3.0 | 2.5 | 4.5 | 3.2 (1.3) | 3.0 |
| Detergent Control 2 + Rinse Aid Control 1 | 5.0 | 4.5 | 5.0 | 5.0 | 4.5 | 5.0 | 4.9 (0.3) | 3.0 |
| Exp. 1 | 4.0 | 3.5 | 3.5 | 4.0 | 4.0 | 4.5 | 3.9 (0.3) | 1.0 |

Example 4

7-Cycle Spot, Film & Soil Removal Evaluation for Institutional Warewash Detergents or Rinse Aids To test the ability of compositions to clean glass and plastic, twelve 10 oz. Libbey heat resistant glass tumblers and four Newport plastic tumblers were used. The glass tumblers were cleaned prior to use.

A food soil solution was prepared using a 50/50 combination of beef stew and hot point soil. The concentration of the solution was about 2000 ppm. The soil included two cans of Dinty Moore Beef Stew (1360 grams), one large can of tomato sauce (822 grams), 15.5 sticks of Blue Bonnet Margarine (1746 grams) and powered milk (436.4 grams).

The dishmachine was then filled with an appropriate amount of water. After filling the dishmachine with the water, the heaters were turned on. The final rinse temperature was adjusted to about 180.degree. F. The glasses and plastic tumblers were soiled by rolling the glasses in a 1:1 (by volume) mixture of Campbell's Cream of Chicken Soup: Kemp's Whole Milk three times. The glasses were then placed in an oven at about 160.degree. F. for about 8 minutes. While the glasses were drying, the dishmachine was primed with about 120 grams of the food soil solution, which corresponds to about 2000 ppm of food soil in the pump.

Figure 4:
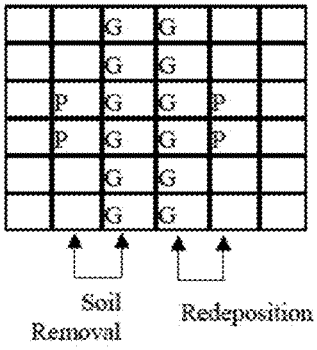
FIG. 4 shows the arrangement of ware on a Raburn rack as used in Example 4 and which rows of ware were tested for soil removal versus redeposition. "G" represents a glass tumbler and "P" represents a plastic tumbler.

The soiled glass and plastic tumblers were placed in the Raburn rack (see FIG. 4, which depicts the arrangement; P=plastic tumbler; G=glass tumbler) and the rack was placed inside the dishmachine. The first two columns with the tumblers were tested for soil removal while the second two columns with the tumblers were tested for redeposition.

The dishmachine was then started and run through an automatic cycle. When the cycle ended, the top of the glass and plastic tumblers were mopped with a dry towel. The glass and plastic tumblers being tested for soil removal were removed and the soup/milk soiling procedure was repeated. The redeposition glass and plastic tumblers were not removed.

At the beginning of each cycle, an appropriate amount of detergent and food soil were added to the wash tank to make up for the rinse dilution. The soiling and washing steps were repeated for seven cycles.

The glass and plastic tumblers were then graded for protein accumulation using Coommassie Brilliant Blue R stain followed by destaining with an aqueous acetic acid/methanol solution. The Coommassie Brilliant Blue R stain was prepared by combining about 1.25 g of Coommassie Brilliant Blue R dye with about 45 mL of acetic acid and about 455 mL of 50% methanol in distilled water. The destaining solution consisted of 45% methanol and 10% acetic acid in distilled water. The amount of protein remaining on the glass and plastic tumblers after destaining was rated visually on a scale of 1 to 5. A rating of 1 indicated no protein was present after destaining. A rating of 2 indicated that random areas (barely perceptible) were covered with protein after destaining. A rating of 3 indicated that about a quarter of the surface was covered with protein after destaining. A rating of 4 indicated that about half of the glass/plastic surface was covered with protein after destaining. A rating of 5 indicated that the entire surface was coated with protein after destaining.

The ratings of the glass tumblers tested for protein removal were averaged to determine an average protein removal rating from glass surfaces and the ratings of the plastic tumblers tested for protein removal were averaged to determine an average protein removal rating from plastic surfaces. Similarly, the ratings of the glass tumblers tested for redeposition were averaged to determine an average protein redeposition rating for glass surfaces and the ratings of the plastic tumblers tested for protein redeposition were averaged to determine an average protein redeposition rating for plastic surfaces.

Evaluation Results:

Glasses are rated visually in the glass viewing area against a black background. Rate each set of glasses as a set, i.e., all redeposition glasses for all products tested. An overall average can be determined for each set. The rating scale used is shown in Table 12.

TABLE 12

| Rating | Spots | Film | Protein |
|---|---|---|---|
| 1 | No spots | No Film | No Protein |
| 2 | Spots at random | 20% of surface covered in film | 20% remains |
| 3 | ¼ glass spotted | 40% of the surface covered in film | 40% remains |
| 4 | ½ glass spotted | 60% of the surface covered in film | 80% remains |
| 5 | Whole glass spotted | At least 80% of the surface covered in film | 100% remains |

The results of the 7-Cycle test are provided in Tables 13 and 14 showing average spotting, film, and protein staining ratings (with standard deviation) for glasses and plastic tumblers.

TABLE 13

| 7-cycle Redeposition | Exp. | Detergent Control 1 | Detergent Control 2 | Detergent Control 1 + Rinse Aid Control 2 | Detergent Control 2 + Rinse Aid Control 1 | Exp. 1 |
|---|---|---|---|---|---|---|
| Avg. Glass Score Spots | 1 | 5.0 (0.0) | 5.0 (0.0) | 1.0 (0.0) | 5.0 (0.0) | 3.5 (1.4) |
| | 2 | | | | | 2.3 (0.4) |
| | 3 | | | | | 5.0 (0.0) |
| Avg. Glass Score Film | 1 | 1.0 (0.0) | 1.2 (0.2) | 1.77 (0.2) | 1.0 (0.0) | 2.9 (1.1) |
| | 2 | | | | | 2.6 (0.5) |
| | 3 | | | | | 1.0 (0.0) |
| Avg. Protein Glass Score | 1 | 1.0 (0.0) | 1.0 (0.0) | 1.0 (0.0) | 1.0 (0.0) | 1.0 (0.0) |
| | 2 | | | | | 1.0 (0.0) |
| | 3 | | | | | 1.0 (0.0) |
| Avg. Protein Plastic Score | 1 | 1.0 (0.0) | 1.0 (0.0) | 1.0 (0.0) | 1.0 (0.0) | 1.0 (0.0) |
| | 2 | | | | | 1.0 (0.0) |
| | 3 | | | | | 1.0 (0.0) |

TABLE 14

| 7-cycle Soil removal | Exp. | Detergent Control 1 | Detergent Control 2 | Detergent Control 1 + Rinse Aid Control 2 | Detergent Control 2 + Rinse Aid Control 1 | Exp. 1 |
|---|---|---|---|---|---|---|
| Avg. Glass Score Spots | 1 | 5.0 (0.0) | 4.8 (0.2) | 1.0 (0.0) | 4.2 (1.1) | 2.1 (0.6) |
| | 2 | | | | | 2.4 (0.6) |
| | 3 | | | | | 5.0 (0.0) |
| Avg. Glass Score Film | 1 | 1.1 (0.2) | 4.4 (0.2) | 4.1 (0.9) | 4.8 (0.2) | 4.7 (0.5) |
| | 2 | | | | | 2.3 (0.2) |
| | 3 | | | | | 1.8 (0.4) |
| Avg. Protein Glass Score | 1 | 1.3 (0.3) | 5.0 (0.0) | 1.3 (0.3) | 5.0 (0.0) | 3.5 (0.5) |
| | 2 | | | | | 1.3 (0.3) |
| | 3 | | | | | 2.0 (0.5) |

TABLE 14-continued

| 7-cycle Soil removal | Exp. | Detergent Control 1 | Detergent Control 2 | Detergent Control 1 + Rinse Aid Control 2 | Detergent Control 2 + Rinse Aid Control 1 | Exp. 1 |
|---|---|---|---|---|---|---|
| Avg. Protein Plastic Score | 1 | 1.0 (0.0) | 5.0 (0.0) | 1.0 (0.0) | 5.0 (0.0) | 1.0 (0.0) |
| | 2 | | | | | 2.0 (0.0) |
| | 3 | | | | | 1.5 (0.0) |

These Examples demonstrate that the compositions of the present invention, provided similar, substantially similar, or better performance when compared with existing detergents and existing detergents and rinse aids in most categories of cleaning and antiredeposition in a traditional warewash procedure.

The inventions being thus described, it will be obvious that the same may be varied in many ways. Such variations are not to be regarded as a departure from the spirit and scope of the inventions and all such modifications are intended to be included within the scope of the following claims. The above specification provides a description of the manufacture and use of the disclosed compositions and methods. Since many embodiments can be made without departing from the spirit and scope of the invention, the invention resides in the claims.

What is claimed is:

1. An alkaline liquid detergent and rinsing composition comprising: from about 40 wt. % to about 85 wt % of an alkalinity source;

at least two nonionic surfactants, wherein the nonionic surfactants comprise from about 0.1 wt. % to about 10 wt. % of a $C_8$-$C_{18}$ alcohol alkoxylate with about 10 to about 30 moles of ethylene oxide and from about 1 wt % to about 10 wt. % of a EO/PO copolymer, wherein the EO/PO copolymer does not contain any other alkyl groups; and an EO/PO copolymer, wherein the alcohol alkoxylate is in an amount of from about 1 wt. % to about 10 wt. %, and wherein the EO/PO copolymer and alcohol alkoxylate are in a ratio of between about 3:1 to 1:3;

from about 10 wt. % to about 35 wt % of a builder;

from about 1 wt. % to about 40 wt. % of a polymer comprising a polycarboxylic acid polymer, copolymer, and/or terpolymer, wherein said polycarboxylic acid polymer, copolymer, and/or terpolymer is an acrylic/maleic acid copolymer;

wherein said composition is free of a fatty acid or salt thereof; and wherein said composition performs both a cleaning and rinsing function.

2. The composition of claim 1, wherein said alkalinity source is present from about 45 wt % to about 75 wt. %, and wherein said polymer is present from about 1 wt. % to about 10 wt. %.

3. The composition of claim 1, wherein said EO/PO copolymer and alcohol alkoxylate are in a ratio of about 1:1.

4. The composition of claim 1, wherein said composition provides substantially similar cleaning and rinsing performance as separate detergent and rinse aid compositions.

5. The composition of claim 1, further comprising a neutralizing agent in an amount between 0.1 wt-% and about 50 wt-%.

6. The composition of claim 5, wherein the alkalinity source comprises an alkali metal carbonate, and wherein the neutralizing agent comprises up to about 10 wt-% alkali metal hydroxide.

7. The composition of claim 6 further comprising an enzyme.

8. The composition of claim 1, wherein the polymer is present from about 0.1 wt-% to about 20 wt-%.

9. A method of cleaning and rinsing ware comprising:

contacting ware with the alkaline liquid detergent composition according to claim 1;

rinsing said ware with water;

wherein no separate rinse aid composition is employed in the method, and wherein said alkaline detergent composition provides at least substantially similar cleaning and rinsing performance as separate detergent and rinse aid compositions.

10. The method of claim 9, wherein said alkalinity source is present from about 10 wt-% to about 90 wt-%, wherein said nonionic surfactant is present from about 0.1 to about 80 wt-%, and wherein said polymer is present from about 0.1 to about 50 wt-%.

11. The method of claim 9, wherein said alcohol alkoxylate and EO/PO copolymers are in a ratio of between about 3:1 to 1:3.

12. The method of claim 9, wherein the alkaline detergent composition further comprises a neutralizing agent in an amount between about 0.1 wt-% and about 50 wt-%.

13. The method of claim 12, wherein the alkalinity source comprises an alkali metal carbonate, wherein the alkalinity source is substantially free of alkali metal hydroxide, and wherein the neutralizing agent comprises up to about 10 wt-% alkali metal hydroxide.

14. The method of claim 13, wherein the alkaline detergent composition further comprises an enzyme.

15. The method of claim 9, wherein the polymer is present from about 0.1 to about 40 wt-%.

16. A liquid, alkaline detergent composition comprising:

25-80% of an alkali metal carbonate;

5-40% of a builder selected from the group consisting of sodium tripolyphosphate, 1-hydroxyethylidene-1,1-diphosphonic acid, methylglcine-N,N-diacetic acid, glutamic acid-N,N-diacetic acid, ethylenediamine tetraacetic acid, and aspartic acid-N,N-diacetic acid; and 1-10% of nonionic surfactant comprising a $C_8$-$C_{18}$ alcohol ethoxylate with about 10 to about 30 moles of ethylene oxide and an EO/PO copolymer, wherein the EO/PO copolymer does not contain any other alkyl groups; and 1-10% of acrylic/maleic copolymer;

wherein the composition is free of fatty acids and salts thereof, and wherein the composition is used to clean and rinse wares without the use of an additional rinse aid composition.

17. The composition of claim 16, wherein said alcohol alkoxylate and EO/PO copolymer are in a ratio of between about 3:1 to 1:3.

18. The composition of claim 16, wherein the acrylic/maleic copolymer has a molecular weight from about 1,000 to about 25,000 g/mol.

19. The composition of claim 16, wherein the liquid, alkaline detergent composition is formed in an aqueous liquid and/or solvent system, wherein the composition is dissolved or suspending in water and/or a solvent.

* * * * *